US006953364B2

(12) United States Patent
Nakamura

(10) Patent No.: US 6,953,364 B2
(45) Date of Patent: Oct. 11, 2005

(54) CONNECTOR, A SHORTING TERMINAL AND A METHOD OF ASSEMBLING IT

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/739,995

(22) Filed: Dec. 18, 2003

(65) Prior Publication Data

US 2004/0132334 A1 Jul. 8, 2004

(30) Foreign Application Priority Data

Dec. 19, 2002 (JP) ..... 2002-368814
Dec. 19, 2002 (JP) ..... 2002-368815

(51) Int. Cl.[7] ..... H01R 31/08
(52) U.S. Cl. ..... 439/507; 439/352; 439/489
(58) Field of Search ..... 439/352, 357, 439/489, 807, 507

(56) References Cited

U.S. PATENT DOCUMENTS 5,145,356 A * 9/1992 Minnis ..... 439/352
5,391,087 A * 2/1995 Fukuda ..... 439/188
5,618,201 A * 4/1997 Yagi et al. ..... 439/489
5,743,760 A 4/1998 Inaba et al.

FOREIGN PATENT DOCUMENTS

JP 2002-170629 6/2002

* cited by examiner

*Primary Examiner*—Truc Nguyen
(74) *Attorney, Agent, or Firm*—Gerald E. Hespos; Anthony J. Casella

(57) ABSTRACT

A plurality of male terminal fittings (17) and a shorting terminal (23) can be accommodated into a male housing (10). The shorting terminal (23) has a main portion (27), resilient contact pieces (28) for contacting the male terminal fittings (17), and pushable pieces (29) to be pushed for inserting the shorting terminal (23) into the male housing (10). The pushable pieces (29) are bent at the main portion (27) such that plate surfaces thereof extend along a pushing direction of the shorting terminal (23). The male housing (10) has receiving portions (30) for receiving the pushable pieces (29) to restrict a depth to which the shorting terminal (23) is pushed.

8 Claims, 24 Drawing Sheets

CONNECTOR, A SHORTING TERMINAL AND A METHOD OF ASSEMBLING IT

BACKGROUND OF THE INVENTION

1. Field of the Invention

The invention relates to a shorting terminal and to a connector with a shorting terminal and/or with a partial connection detecting function.

2. Description of the Related Art

U.S. Pat. No. 5,743,760 and FIG. 10 herein disclose a connector with a shorting terminal. As shown in FIG. 10, the connector has a housing 1 that accommodates a plurality of terminal fittings 2 and a shorting terminal 3. The housing 1 can be connected to a mating housing that has mating terminal fittings. The shorting terminal 3 includes a contact piece 3*a* that contacts and shorts the mating terminal fittings. The shorting terminal 3 also has pushable pieces 3*b* that can be pushed by a jig 5. Additionally, the shorting terminal 3 has an abutting portion 3*c* that can abut against a receiving portion 4 in the housing 1 to restrict a depth to which the shorting terminal 3 is pushed.

The shorting terminal 3 may be mounted into the housing 1 by an automatic machine that stops pushing when the shorting terminal 3 is pushed by a specified stroke.

The pushable pieces 3*b* and the abutting portion 3*c* are spaced apart and are formed at separate operation steps in the production process. Thus, there is a high chance that front and rear positions of either the pushable pieces 3*b* or the abutting portion 3*c* will deviate from specified positions due to manufacturing tolerances. Such a deviation may cause the shorting terminal 3 to be mounted before a proper position. Alternatively, the shorting terminal 3 may be pushed excessively. Thus, the pushable pieces 3*b* may be deformed even though the automatic machine pushes the shorting terminal 3 by the specified stroke. In addition, the jig 5 may deform and incline the pushable pieces 3*b*.

Japanese Unexamined Patent Publication No. 2002-170629 discloses a connector with a partial connection detection function. This connector has male and female housings that are connectable with each other. A substantially tubular slider surrounds the female housing, and springs are provided between the female housing and the slider. The female housing and the slider fit into a receptacle of the male housing. A resilient displacing portion in the receptacle pushes the slider back and compresses the springs. Biasing forces of the springs are released and separate the housings if a connecting operation is interrupted halfway. As a result, partial connection is prevented. The resilient displacing portion is displaced resiliently and disengaged from the slider if the housings are connected. Thus, the slider is moved forward by the biasing forces of the springs, and simultaneously the resilient displacing portion engages a lock.

This connector has a retainer for locking female terminal fittings in cavities of the female housing. The retainer is mounted in the female housing for movement along a widthwise direction between a partial locking position and a full locking: position. Locking sections of the retainer are retracted from the cavities when the retainer is in the partial locking position. Thus, the female terminal fittings can be inserted into the cavities and withdrawn from the cavities. On the other hand, the locking sections enter the cavities when the retainer is in the full locking position to lock the female terminal fittings. The retainer at the partial locking position projects out from the outer side surface of the female housing and interferes with the slider. However, the retainer at the full locking position is flush with the outer side surface of the female housing and does not interfere with the slider. Accordingly, the two housings cannot be connected when the retainer has not reached the full locking position and partial insertion of the retainer can be detected.

A projecting amount of the detector from the outer side surface of the female housing gradually decreases as the retainer approaches the full locking position. Thus, the slider may be able to move backward immediately before the retainer reaches the full locking position. As a result, a situation where the female terminal fittings are locked incompletely by the retainer may be overlooked.

In addition, a clearance is defined between the female housing and the slider to smooth movement of the slider. Thus, it is difficult to prevent a backward movement of the slider immediately before the retainer reaches the full locking position.

The invention was developed in view of the above problems, and an object thereof is to improve operability of the connector.

SUMMARY OF THE INVENTION

The invention relates to a connector with a housing for accommodating a plurality of terminal fittings and at least one shorting terminal. The shorting terminal includes a main portion, at least one contact piece and at least one pushable piece. The contact piece can be brought into shorting contact with the terminal fittings or a plurality of mating terminal fittings in a mating housing. The pushable piece can be pushed into the housing by a jig and is bent at the main portion so that a plate surface of the pushable piece extends substantially along a pushing direction of the shorting terminal. The housing includes a receiving portion for receiving the pushable piece to restrict a depth of insertion of the shorting terminal is pushed or inserted.

The pushable piece of the shorting terminal has at least one pushable portion for being pushed by the jig and an abutting portion for abutting against the receiving portion. Accordingly, the front and rear positions of the pushable piece are not likely to deviate from the proper positions due to a forming error, as compared to the prior art where the pushable portion and the abutting portion are separate. Thus, the shorting terminal can be pushed only by a specified stroke and can be accommodated easily at a substantially proper position. Further, the pushable piece is bent at the main portion so that the plate surface of the pushable piece extends substantially along the pushing direction. Thus, the pushable piece can be pushed at its edge and is unlikely to be inclined by a pushing force.

Two pushable pieces preferably are formed at opposite lateral ends of the main portion of the shorting terminal. Accordingly, the shorting terminal can be inserted into the housing by pushing the pushable pieces at both opposite lateral ends of the main portion. As a result, the shorting terminal is unlikely to shake during the pushing process.

The pushable pieces preferably are held in sliding contact with corresponding surfaces of receiving portions in the process of pushing the shorting terminal. The receiving portions preferably are grooves that have open front ends, and the length and height of the grooves substantially equal or slightly exceed the length and height of the pushable pieces.

Locking means preferably are provided on the shorting terminal and/or a shorting-terminal accommodating chamber for locking the shorting terminal that has been pushed to a proper depth in the shorting-terminal accommodating chamber.

A dimension of the pushable pieces along the pushing direction preferably is more than ⅓ of the corresponding dimension of the main portion.

The front ends of the pushable pieces preferably are substantially aligned with the front ends of the main portion.

The invention also relates to the above-described shorting terminal independent of the housing.

The invention further relates to the above-described method of assembling a shorting terminal with a housing of a connector.

The invention also relates to a connector with a housing that may be the above-described housing and that is connectable with a mating housing. The housing has a plurality of cavities and terminal fittings can be inserted in and withdrawn from the cavities. A retainer is movable in a direction intersecting inserting and withdrawing directions of the terminal fittings and can enter the cavities to lock the terminal fittings. A slider is provided movably on the housing, and a biasing member is arranged between the slider and the housing. The biasing member is compressible as the slider is moved backward and accumulates a biasing force for separating the housings. A resilient displacing portion on the mating housing pushes the slider back while the two housings are being connected. The resilient displacing portion is displaced resiliently and disengages from the slider when the housings are connected properly thereby releasing the biasing force of the biasing member to move the slider forward. The retainer includes an engaging portion that enters an interference space where the engaging portion can interfere with the slider while the retainer is being moved to the proper position. The engaging portion is restored to retract from the interference space as the retainer reaches the proper position.

The retainer enters the cavities to lock the terminal fittings that have been inserted properly into the cavities. At this time, the engaging portion is substantially retracted from the interference space, and movement of the slider is permitted.

The slider is pushed backward by the resilient displacing portion while the housing is being connected with the mating housing. Thus, the biasing member is compressed and accumulates a biasing force. The biasing force of the biasing member is released to separate the housings if the connecting operation is interrupted at an intermediate stage. As a result, partial connection is prevented. When the two housings are connected properly, the resilient displacing portion is displaced and disengages from the slider. Thus, the biasing force of the biasing member is released to move the slider forward.

The retainer may not completely reach the proper position, and hence the engaging portion is in the interference space. Thus, a backward movement of the slider is prevented by the interference of the slider with the engaging portion, and the connecting operation cannot be performed. As a result, the partial insertion of the retainer can be detected.

A projecting distance of the engaging portion into the interference space preferably increases while the retainer is moved to the proper position. Thus, a sufficient interference area with the slider can be ensured even immediately before the retainer reaches the proper position. As a result, the partial insertion of the retainer is assured of being detected.

The engaging portion preferably has a holding arm that is engageable with a holding portion in the housing to hold the retainer at a proper position where the retainer locks the terminal fittings. The holding arm preferably is displaced resiliently upon moving onto the holding portion. Thus, the holding arm enters the interference space where the holding arm interferes with the slider while the retainer is being moved to the proper position. The holding arm is restored to retract from the interference space as the retainer reaches the proper position.

The slider preferably is movable forward and back substantially along the inserting and withdrawing directions of the terminal fittings.

The slider preferably is formed to substantially face the holding arm.

The interference space preferably is a recess in a surface of the slider facing the holding arm.

The holding arm preferably is covered by the part of the slider where the recess is formed, and therefore is prevented from being damaged by external matter or the like.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
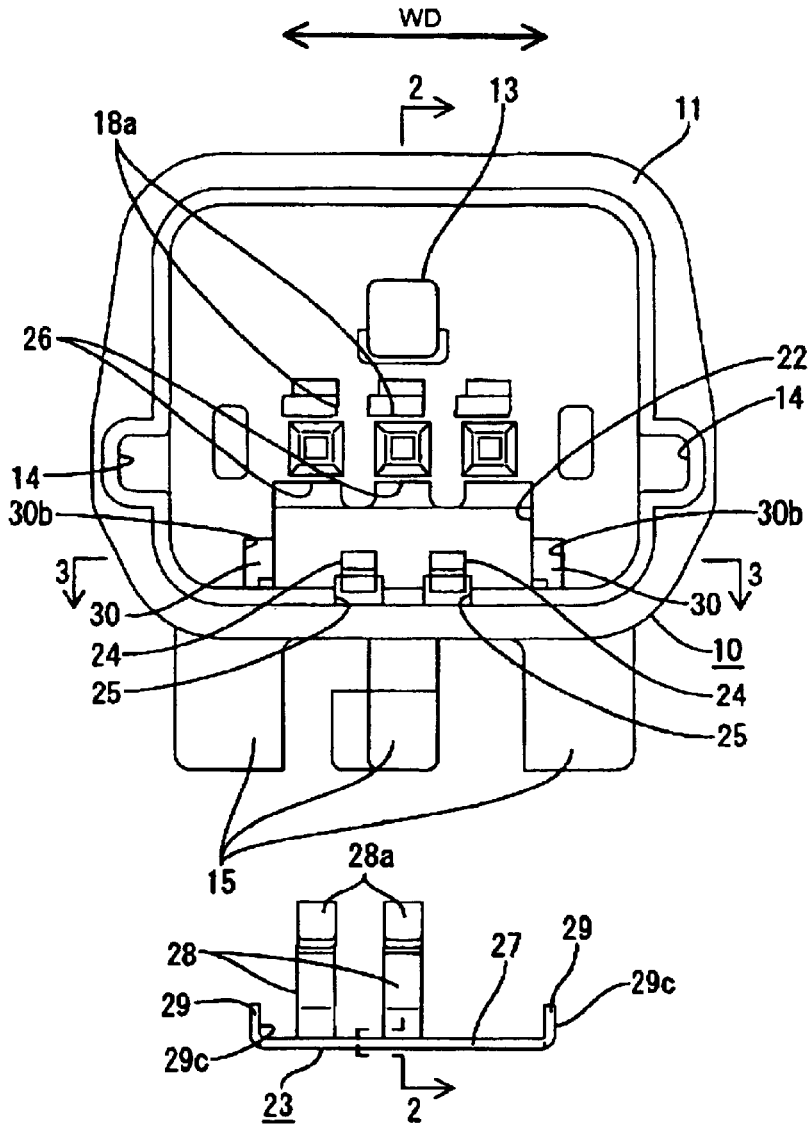
FIG. 1 is a front view of a male housing and a shorting terminal according to one embodiment of the invention.

A first embodiment of the invention is described with reference to FIGS. 1 to 9. In this embodiment, three male terminal fittings 17 and a shorting terminal 23 for shorting two of the male terminal fittings 17 are accommodated in a male housing 10. The male housing 10 is connectable with a mating female housing 40 in which a slider 44 and compression coil springs 45 are mounted. In the following description, sides of the housings 10, 40 to be connected with each other are referred to as the front sides.

Figure 2:
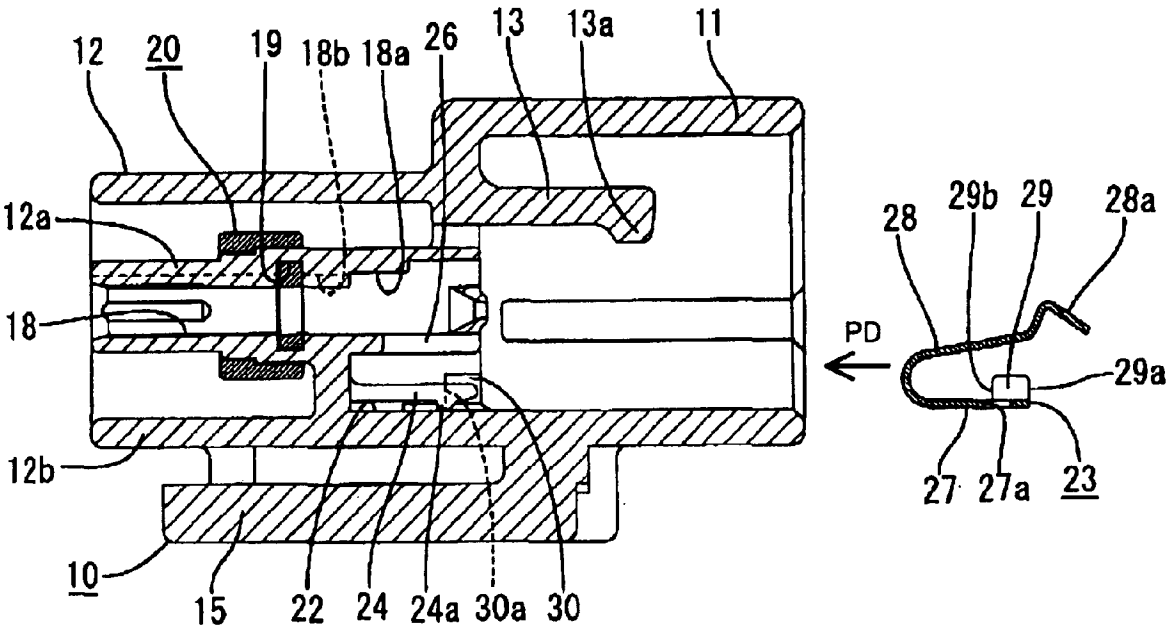
FIG. 2 is a section along 2—2 of FIG. 1 showing the male housing having a retainer mounted at a partial locking position and the shorting terminal.

The male housing 10 is made e.g. of a synthetic resin and is comprised of a receptacle 11 in the form of a rectangular tube having an open front end and a terminal accommodating portion 12 for accommodating the male terminal fittings 17 as shown in FIGS. 1 and 2. The receptacle 11 is configured so that the mating female housing 40 and the slider 44 can be fit therein. A lock arm 13 cantilevers forward from the back surface of the receptacle 11 and is resiliently deformable up and down about a base end thereof. A hook 13*a* projects down from the leading end of the lock arm 13 and is engageable with a lock 42 of the female housing 40. Two opposed guiding recesses 14 are formed in opposite inner side surfaces of the receptacle 11 for guiding movements of the slider 44. A mounting portion 15 projects from the bottom surface of the male housing 10 to mount the male housing 10 on an unillustrated bracket or the like.

The terminal accommodating portion 12 is substantially in the form of double tubes that open backward, and three cavities 18 are arranged substantially side by side along a widthwise direction in an inner tube 12*a* of the terminal accommodating portion 12. The male terminal fittings 17 are crimped into connection with ends of wires 16 and are insertable from behind into the cavities 18. A forwardly open locking groove 18*a* is formed in the upper surface of each cavity 18 and is engageable with a resilient lock 17*a* of each male terminal fitting 17. A rearwardly open stabilizer insertion groove 18*b* is formed at one lateral edge of the upper surface of each cavity 18 for receiving a stabilizer 17*b* of each terminal fitting 17 (see FIG. 5).

Figure 5:
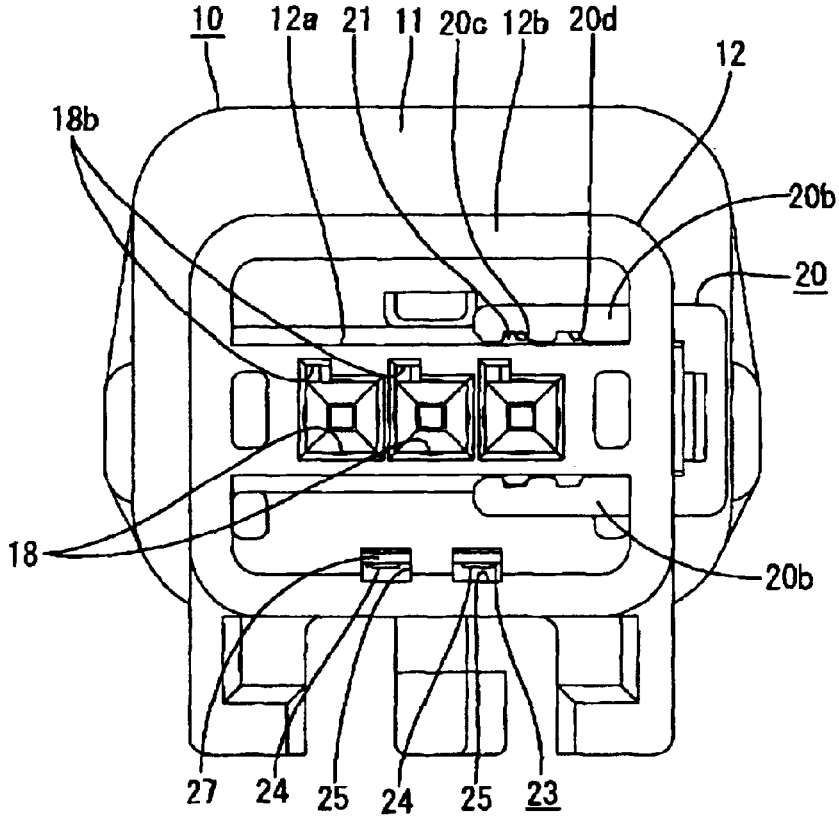
FIG. 5 is a rear view showing the male housing accommodating the shorting terminal and having the retainer mounted at the partial locking position.

A retainer mount hole 19 is formed in one side surface at a rear part of the terminal accommodating portion 12 and intersects the cavities 18. A retainer 20 is insertable into the retainer mount hole 19 and is movable substantially normal to the insertion and withdrawal direction of the terminal fittings 17 between a partial locking position (see FIG. 6) and a full locking position (see FIG. 8). The retainer 20 has locking sections 20*a* that are retracted sideways from the cavities 18 when the retainer 20 is at the partial locking position of FIG. 6 to permit insertion and withdrawal of the male terminal fittings 17 into and from the cavities 18. However, the locking sections 20*a* enter the cavities 18 when the retainer 20 is at the full locking position of FIG. 8 to engage jaws 17*c* of the male terminal fittings 17 for redundantly locking the male terminal fittings 17. As shown in FIG. 5, the retainer 20 includes upper and lower holding arms 20*b*. A partial locking recess 20*c* and a full locking recess 20*d* are formed substantially side by side along transverse direction in each holding arm 20*b* for engaging a corresponding holding projection 21 on the outer surface of the inner tube 12*a* of the terminal accommodating portion 12. The partial locking recesses 20*c* can engage the holding projections 21 to hold the retainer 20 at the partial locking position. Alternatively, the full locking recesses 20*d* can engage the holding projections 21 to hold the retainer 20 at the full locking position.

Figure 3:
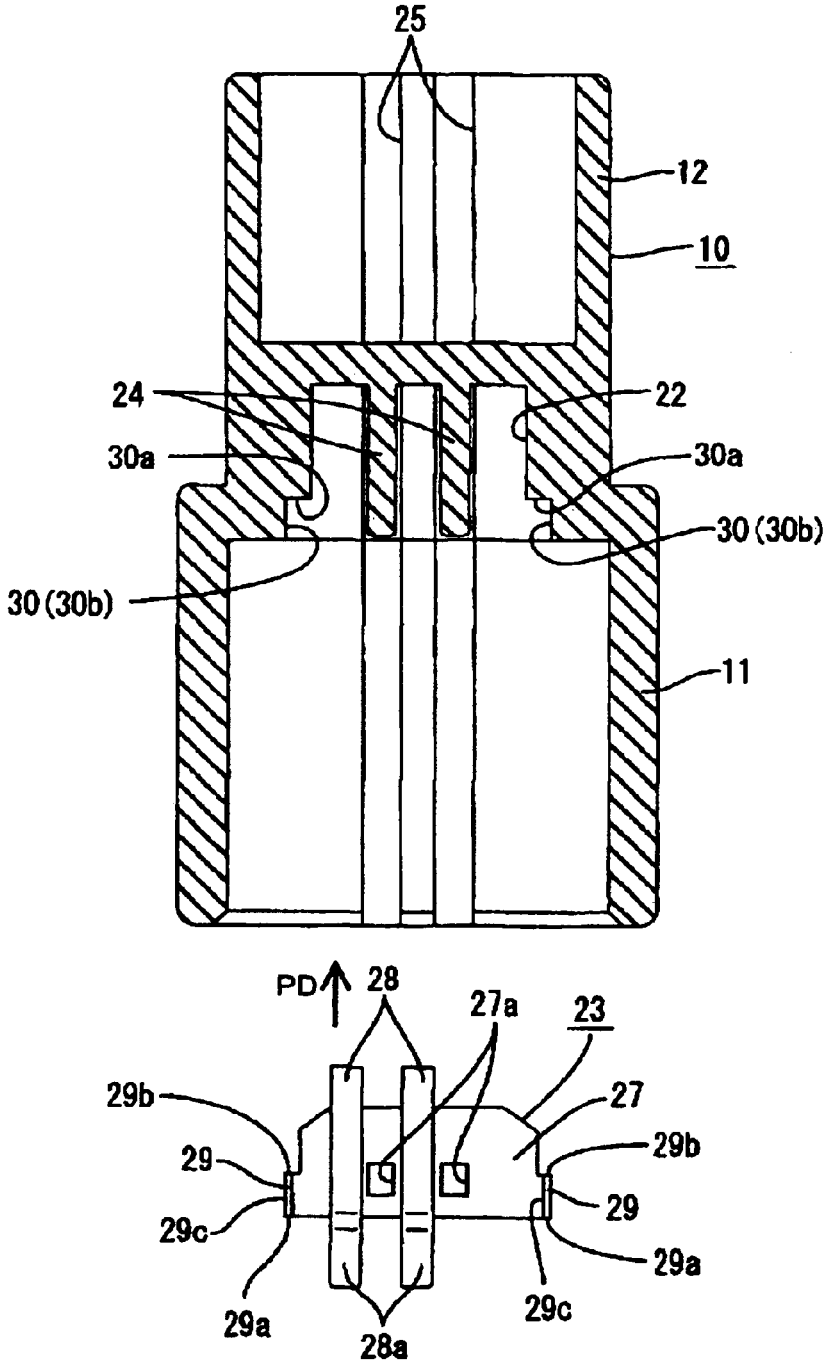
FIG. 3 is a section along 3—3 of FIG. 1 showing the male housing and the shorting terminal.
Figure 4:
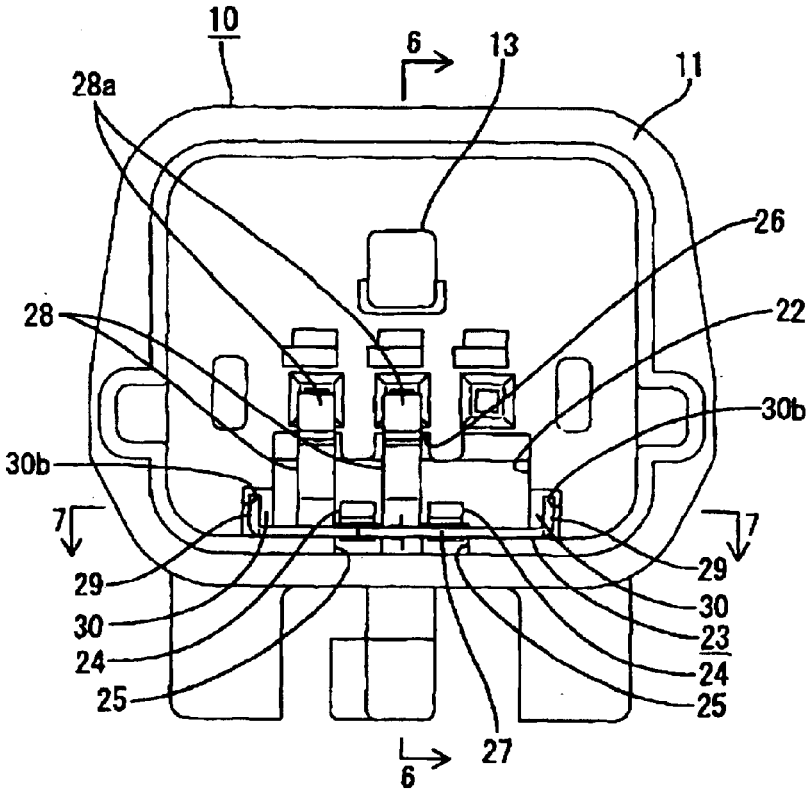
FIG. 4 is a front view showing the male housing accommodating the shorting terminal.

A shorting-terminal accommodating chamber 22 is formed below the respective cavities 18 at a front part of the terminal accommodating portion 12 and has an open front end, as shown in FIGS. 1 to 3. The shorting terminal 23 can be pushed into the shorting-terminal accommodating chamber 22 from the front and along a pushing direction PD. The shorting-terminal accommodating chamber 22 is formed over a sufficient width to cross all of the cavities 18. Two holding pieces 24 project from the back surface of the shorting-terminal accommodating chamber 22 for holding the shorting terminal 23. Both holding pieces 24 are at middle positions between the cavities 18 and have a cantilever shape. A hook 24*a* projects from the lower surface of the leading end of each holding piece 24 and engages a corresponding locking hole 27*a* in the shorting terminal 23. The hook 24*a* has a rear locking surface aligned substantially vertically for engaging the edge of the locking hole 27*a*. The hook 24*a* also has a slanted front surface that slopes down and to the back so that the hook 24*a* can easily move onto a main portion 27 of the shorting terminal 23. Two mold-removal grooves 25 are formed in the bottom surface and the rear surface of the shorting-terminal accommodating chamber 22 to remove molds for molding the holding pieces 24. Both mold-removal grooves 25 have open front and rear ends and are formed to be substantially continuous with both the inner surface of the receptacle 11 (see FIG. 1) and the inner surface of an outer tube 12*b* of the terminal accommodating portion 12 (see FIG. 5). Two open ended escape grooves 26 are formed in parts of the upper wall of the shorting-terminal accommodating chamber 22 substantially corresponding to the bottom walls of the respective cavities 18 for receiving two corresponding resilient contact pieces 28 of the shorting terminal 23.

The shorting terminal 23 is formed into a shape shown in FIGS. 1 to 3 by bending, folding an/or embossing a conductive metallic plate stamped or cut out into a specified shape. The shorting terminal 23 includes the main portion 27 in the form of a substantially flat plate to extend along the bottom surface of the shorting-terminal accommodating chamber 22 and the two resilient contact pieces 28 that project from the rear end of the main portion 27. Two substantially rectangular locking holes 27*a* are formed in the main portion 27 at positions corresponding to the two holding pieces 24. The main portion 27 has the opposite rear corners obliquely cut to facilitate the insertion of the shorting-terminal accommodating chamber 22.

Both resilient contact pieces 28 are at the left sides of the corresponding locking holes 27*a* in FIG. 3, and can contact the male terminal fittings 17 in the middle and left cavities 18 of FIG. 1. The resilient contact pieces 28 are in the form of cantilevers folded back to extend forward from the rear end of the main portion 27 and are resiliently deformable up and down toward and away from the terminal fitting 17. Embossed contacts 28*a* are formed at the leading ends of the resilient contact pieces 28. The contacts 28*a* project into the receptacle 11 and can resiliently contact the lower surfaces of tabs 17*d* of the corresponding male terminal fittings 17.

Two pushable pieces 29 are formed by bending the opposite ends of the main portion 27 of the shorting terminal 23 and can be pushed by a jig or other manipulating tool along the pushing direction PD and into the shorting-terminal accommodating chamber 22. Each pushable piece 29 initially projects sideways from the main body 27, but then is bent at substantially a right angle. A plate surface 29*c* of the pushable piece 29 extends substantially forward and back along the pushing direction PD of the shorting terminal 23. A dimension of the pushable pieces 29 along forward and backward directions may be more than half, but preferably is slightly longer than ⅓ of the corresponding dimension of the main portion 27, and the front ends of the pushable pieces 29 substantially align with the front end of the main portion 27. Front edges 29*a* of the pushable pieces 29 are pushed back substantially along the pushing direction PD. It should be noted that the front and rear edges 29*a*, 29*b* of the pushable pieces 29 extend substantially vertically straight.

Two receiving grooves 30 are provided at opposite lateral ends of the shorting-terminal accommodating chamber 22 for receiving the pushable pieces 29 and for engaging the rear edges 29*b* of the pushable pieces 29 to restrict an insertion depth as the shorting terminal 23 is mounted. The receiving grooves 30 have open front ends, and the length and height of the receiving grooves 30 are equal to or slightly longer than the length and height of the pushable pieces 29. The rear edges 29*b* of the pushable pieces 29 can contact rear surfaces 30*a* of the receiving grooves 30 when the shorting terminal 23 is inserted in the pushing direction PD to a proper depth in the shorting-terminal accommodating chamber 22. Outer side surfaces of the pushable pieces 29 slide in contact with side surfaces 30*b* of the receiving grooves 30 in the process of pushing the shorting terminal 23. The rear and side surfaces 30*a*, 30*b* of the receiving portions 30 are substantially vertically straight.

The front edges 29*a* of the pushable pieces 29 can be pushed by a jig or the like and the rear edges 29*b* abut against ends of the receiving grooves 30. The front and rear edges 29*a*, 29*b* are formed at once in a stamping step when the conductive metallic plate is formed to create the shorting terminal 23.

The female housing 40 is made e.g. of a synthetic resin, and three female terminal fittings 41 are accommodated therein for electrical connection with the respective male terminal fittings 17. A lock 42 projects from the upper surface of the female housing 40 for engaging the hook 13*a* of the lock arm 13, and engaging recesses 43 are formed in the bottom surface of the female housing 40 for engaging the leading ends of the respective resilient contact pieces 38 of the shorting terminal 23 to resiliently deform the resilient contact pieces 38 down. A substantially tubular slider 44 is mounted around the female housing 40 and is movable forward and back. Compression coil springs 45 are provided between the slider 44 and the female housing 40 and are compressible as the slider 44 is moved back.

An operation for accommodating the shorting terminal 23 and the male terminal fittings 17 into the male housing 10 is described below. However, the accommodating sequence described herein can be changed. In the preferred procedure, the male housing 10 and the shorting terminal 23 are positioned in an automatic machine. The shorting terminal 23 then is pushed into the shorting-terminal accommodating chamber 22 from the front by the automatic machine. More particularly, the front edges 29*a* of the pushable pieces 29 are pushed by a pushing jig of the automatic machine. The pushing jig pushes the pushable pieces 29 substantially straight back in the pushing direction PD along the extension direction of plate surfaces 29*c* of the pushable pieces 29 in the state shown in FIGS. 2 and 3. Thus, the respective resilient contact pieces 28 enter the left sides of the corresponding holding pieces 24 in FIG. 3 and the holding pieces 24 are deformed resiliently up by the main portion 27. In this process, the shorting terminal 23 is accommodated without shaking along widthwise direction WD by the outer side surfaces of the pushable pieces 29 held substantially in sliding contact with the side surfaces 30*b* of the receiving portions 30.

Figure 6:
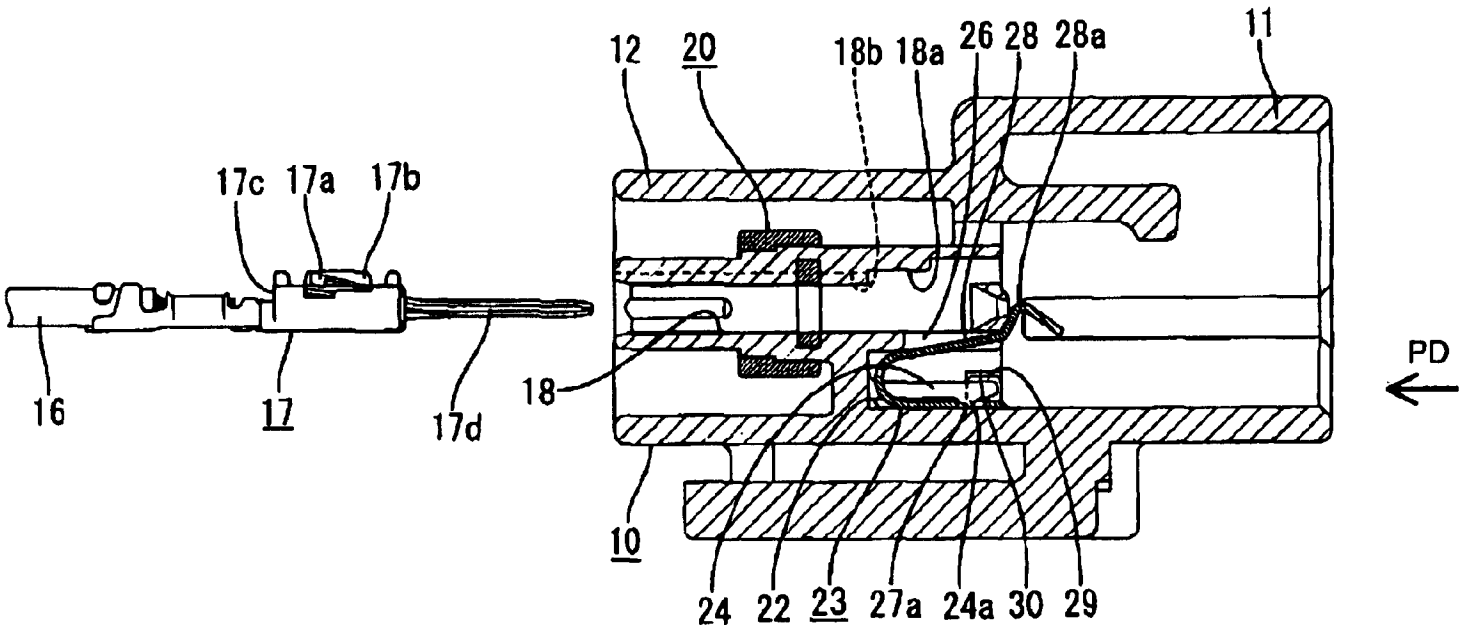
FIG. 6 is a section along 6—6 of FIG. 4 showing the male housing accommodating the shorting terminal and having the retainer mounted at the partial locking position and a male terminal fitting.
Figure 7:
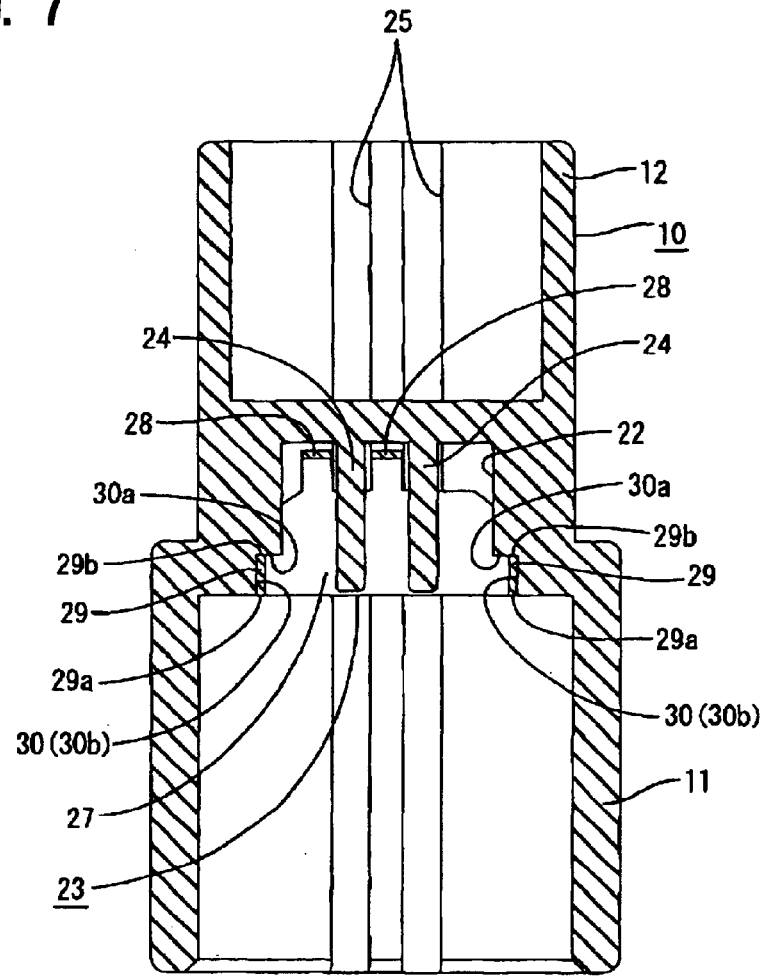
FIG. 7 is a section along 7—7 of FIG. 4 showing the male housing accommodating the shorting terminal.

The shorting terminal 23 is pushed through a predetermined stroke by the automatic machine and then automatically stops. At this time, the shorting terminal 23 is pushed to substantially the proper depth into the shorting-terminal accommodating chamber 22, as shown in FIGS. 6 and 7, the holding pieces 24 are restored and the hooks 24*a* enter and engage the locking holes 27*a*. Accordingly, the shorting terminal 23 is held so as not to come out. The rear edges 29*b* of the pushable pieces 29 abut against the rear surfaces 30*a* of the receiving grooves 30 at this time. Thus, the shorting terminal 23 is prevented from being pushed any further. Further, the contacts 28*a* of the resilient contact pieces 28 are located before the two corresponding cavities 18.

Figure 8:
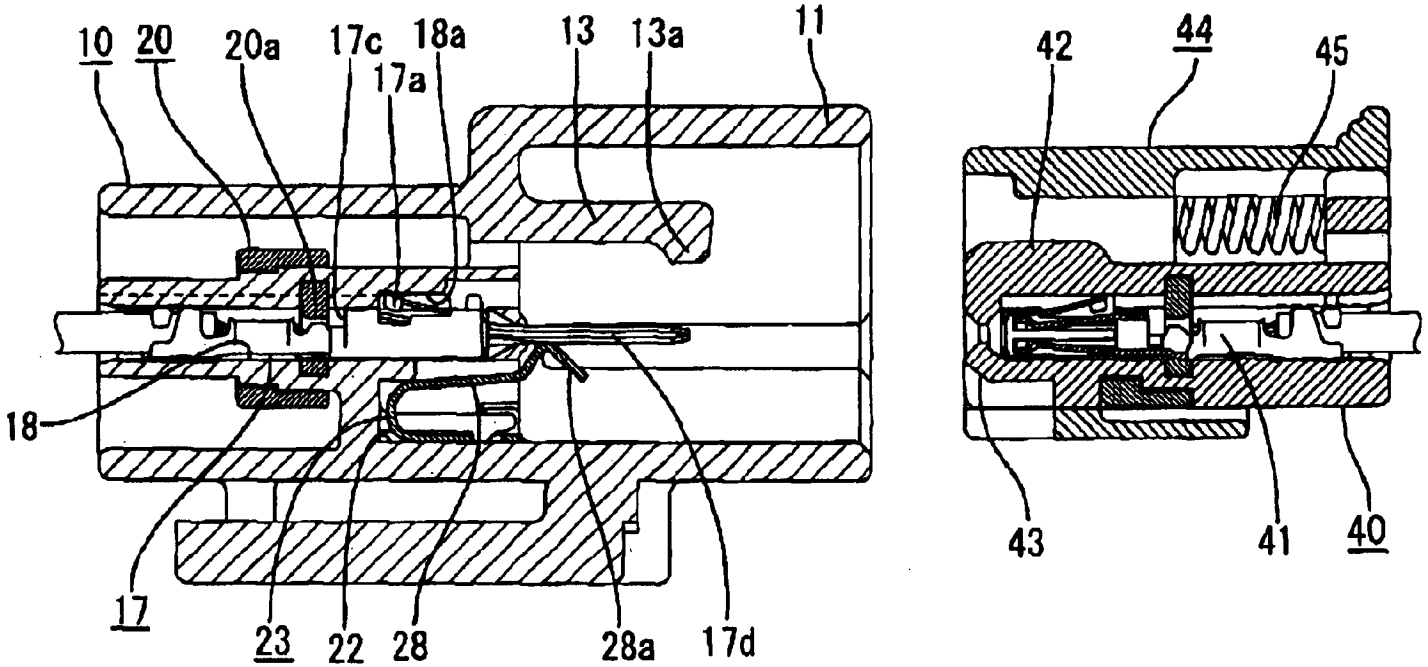
FIG. 8 is a section similar to FIG. 6, but showing a female housing mounted with a slider and the male housing accommodating the male terminals and having the retainer mounted at a full locking position.

The male terminal fittings 17 connected with the wires 16 are inserted into the corresponding cavities 18 from behind while the retainer 20 is held at the partial locking position, as shown in FIG. 6. The tabs 17*d* project forward from the cavities 18 and into the receptacle 11 in the process of inserting the male terminal fittings 17 into the left and middle cavities 18 of FIG. 4. Thus, the tabs 17*d* engage the contacts 28*a* and deform the resilient contact pieces 28 down. The locks 17*a* are restored when the male terminal fittings 17 are inserted into the cavities 18 to substantially proper depths. As a result, the locks 17*a* engage the rear surfaces of the locking grooves 18*a*, as shown in FIG. 8, and partly lock the male terminal fittings 17. The contacts 28*a* of the resilient contact pieces 28 are held resiliently in contact with the tabs 17*d* near their base ends. The retainer 20 is moved to the full locking position after all male terminal fittings 17 have been inserted. Thus, the locking sections 20*a* engage the corresponding jaws 17*c* to lock the male terminal fittings 17 redundantly. In this state, there is no potential difference between the two male terminal fittings 17 resiliently held in contact with the two resilient contact pieces 28 since the two male terminal fittings 17 are shorted with each other.

Figure 9:
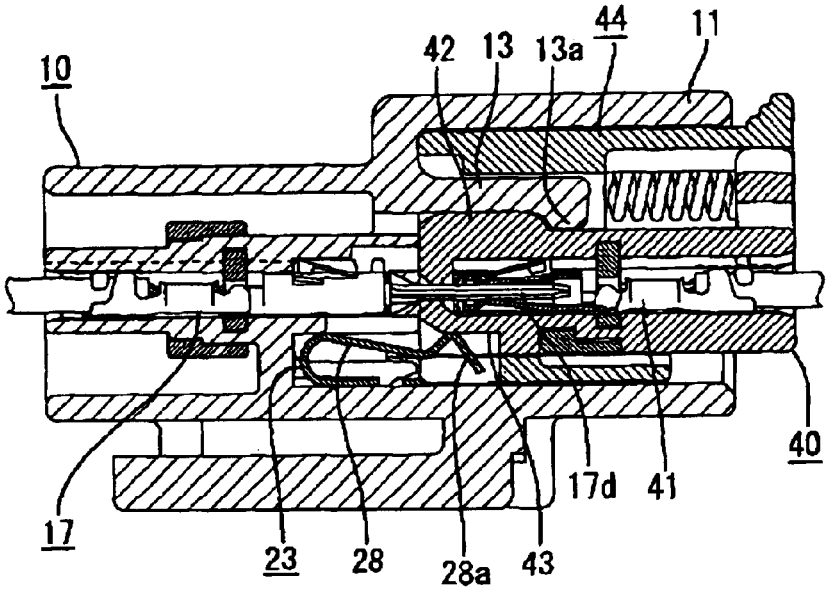
FIG. 9 is a section similar to FIG. 7, but showing the male and female housings properly connected with each other.
Figure 10A:
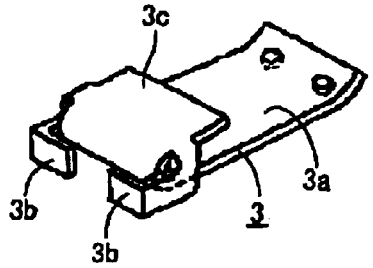
FIG. 10(A) PRIOR ART
FIGS. 10(A) and 10(B) are a perspective view and a section showing a prior art connector.
Figure 10B:
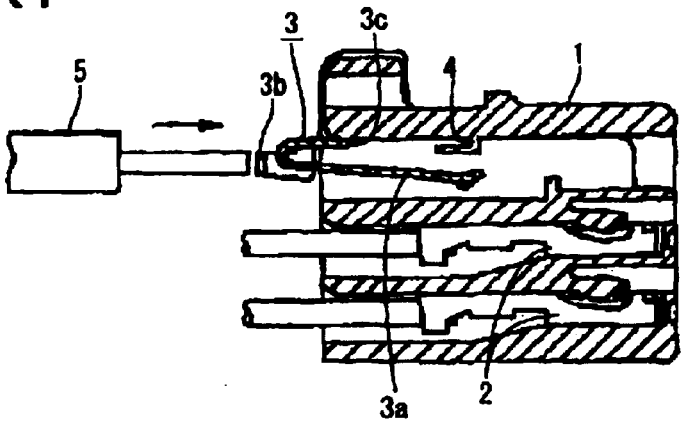
FIG. 10(B) PRIOR ART

The female housing 40 and the slider 44 are fit into the receptacle 11 in the state shown in FIG. 8. Thus, the lock arm 13 moves onto the lock 42 and is displaced resiliently. The lock arm 13 pushes the slider 44 back and compresses the compression coil springs 45. The biasing force accumulated in the compression coil springs 45 is released if the connecting operation is interrupted halfway and separates the housings 10, 40 to prevent partial connection. In this process, the tabs 17*d* contact the female terminal fittings 41 and the engaging recesses 43 then engage the leading ends of both resilient contact pieces 28. As a result, both resilient contact pieces 28 displace down and separate from the tabs 17*d* to cancel the shorted state of the two male terminal fittings 17. The lock arm 13 is restored when the housings 10, 40 are connected properly. Thus, the hook 13*a* engages the lock 42 and the lock arm 13 disengages from the slider 44 to move the slider 44 forward due to the biasing forces of the compression coil springs 45 as shown in FIG. 9.

The shorting terminal 23 and the male terminal fittings 17 may be detached from the male housing 10 in the state shown in FIG. 8 for maintenance or other reason. To detach the shorting terminal 23, both holding pieces 24 are lifted by a jig inserted into the receptacle 11 from the front to disengage from the locking holes 27*a* and another jig is inserted into the mold-removal grooves 25 to push the rear edges 29*b* of the main portion 27 forward (see FIG. 5). To detach the male terminal fittings 17, the retainer 20 is moved from the full locking position to the partial locking position to disengage the locking sections 20*a* from the male terminal fittings 17. Thereafter, the locking portion 17*a* of each male terminal fitting 17 is displaced down toward the main body thereof by a jig inserted into the receptacle 11 from the front to be disengaged from the locking groove 18*a* while the wire 16 is pulled backward.

As described above, each pushable piece 29 has both the front edge 29*a* to be pushed by the automatic machine and the rear edge 29*b* to abut against the receiving portion 30, and these front and rear edges 29*a*, 29*b* are formed at once in the stamping or pressing step of the process of forming the shorting terminal 23. Accordingly, the positions of the front and rear edges 29*a*, 29*b* with respect to forward and backward directions and along the pushing direction PD cannot deviate significantly from proper positions due to a forming error. The shorting terminal 23 can be accommodated to a proper position merely by being pushed by the specified stroke, and can be mounted easily using the automatic machine.

The pushable pieces 29 are bent at the main portion 27 so that the plate surfaces 29*c* extend forward and back substantially parallel to the pushing direction PD of the shorting terminal 23. The bending direction of the pushable pieces 29 is substantially normal to the pushing direction PD. Thus, the front edges 29*a* of the pushable pieces 29 can be pushed, and the pushable pieces 29 are more difficult to incline when subjected to the pushing force. Therefore, the shorting terminal 23 can be mounted easily.

The shorting terminal 23 can be accommodated into the male housing 10 by pushing the two pushable pieces 29 formed at the opposite lateral ends of the main portion 27. Thus, the shorting terminal 23 will not shake during the pushing process.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The positions of the pushable pieces are not limited to the lateral ends of the main portion. For example, a U-shaped slit may be formed in the main portion and the pushable pieces may be bent at this U-shaped slit according to the present invention. Further, the plate surfaces of the pushable pieces may be slightly oblique to forward and backward directions, and the number of the pushable pieces may be one, three or more.

The receiving portions need not be grooves. For example, the receiving portions may project from the inner surfaces of the shorting-terminal accommodating chamber according to the present invention.

The shorting terminal shorts two of the three male terminal fittings in the foregoing embodiment. However, all of the male terminal fittings may be shorted according to the present invention. Further, one resilient contact piece may be brought into contact with a plurality of male terminal fittings.

The shorting terminal shorts the male terminal fittings in the foregoing embodiment. However, the shorting terminal may short the mating female terminal fittings. Specifically, the shorting terminal will not contact the female terminal fittings before and during connection of the housings, whereas the resilient contact pieces of the shorting terminal will contact a plurality of female terminal fittings when the housings are connected, and proper connection of the two housings can be detected by electrically closing a detecting circuit formed by the shorting terminal and the plurality of female terminal fittings.

The shorting-terminal accommodating chamber may be open backward and the shorting terminal may be mounted from behind, i.e. in the substantially same direction as the male terminal fittings are inserted. Further, the shorting terminal may be inserted by hand instead of by the machine.

Converse to the foregoing embodiment, the shorting terminal may be accommodated into the female housing according to the present invention.

The invention has been described with reference to pushable pieces at lateral ends of the main portion. However, pushable pieces may be at an intermediate portion of the main portion between its lateral ends. The pushing pieces may be provided substantially symmetrically more inward than the distal ends of the main portion by cutting away distal parts of the main portion. For example, the main portion may have a step-like configuration in plan view. Moreover, the pushable pieces may be formed by cutting and bending intermediate portions of the main portion.

A further embodiment of the invention is described with reference to FIGS. 11 to 26. In this embodiment, a retainer 136 is assembled with a female housing 130 together with compression coil springs 154, while a slider 147 is fitted on the female housing 130. The female housing 130 is fittable into a mating male housing 110 together with the slider 147. In the following description, sides of the two housings 110, 130 to be connected with each other are referred to as the front side.

Figure 11:
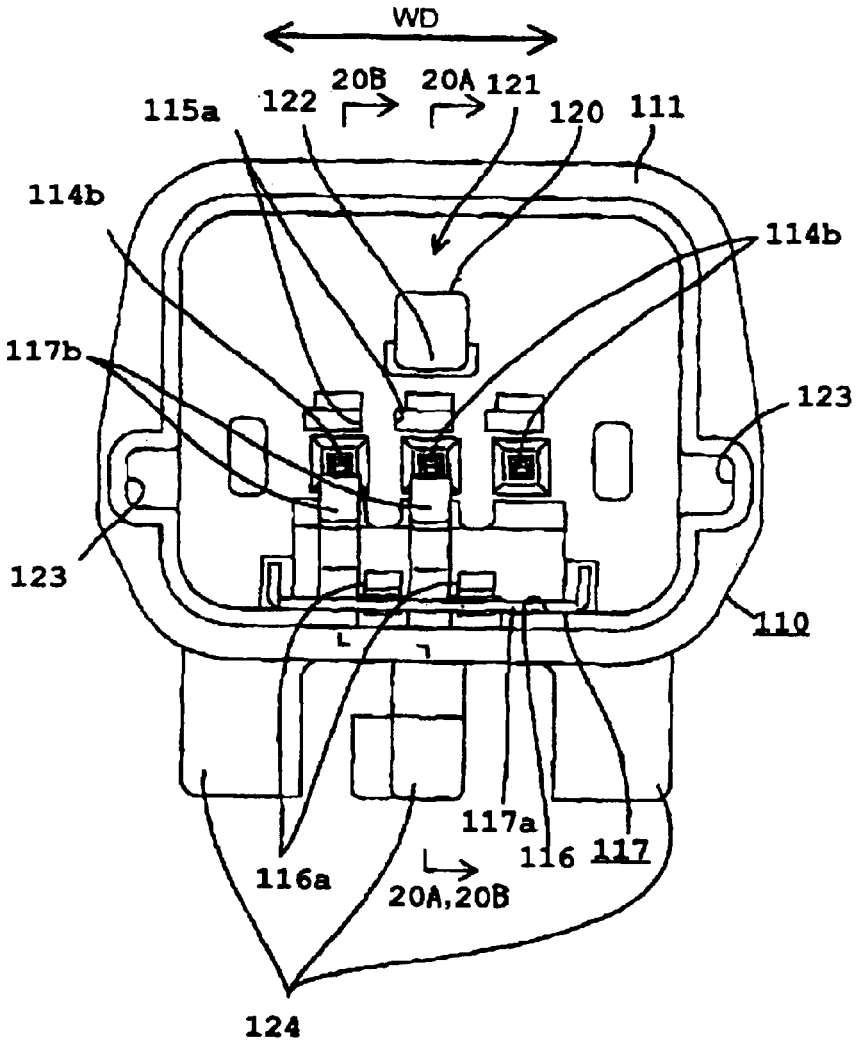
FIG. 11 is a front view of a male housing according to one further preferred embodiment of the invention.
Figure 18A:
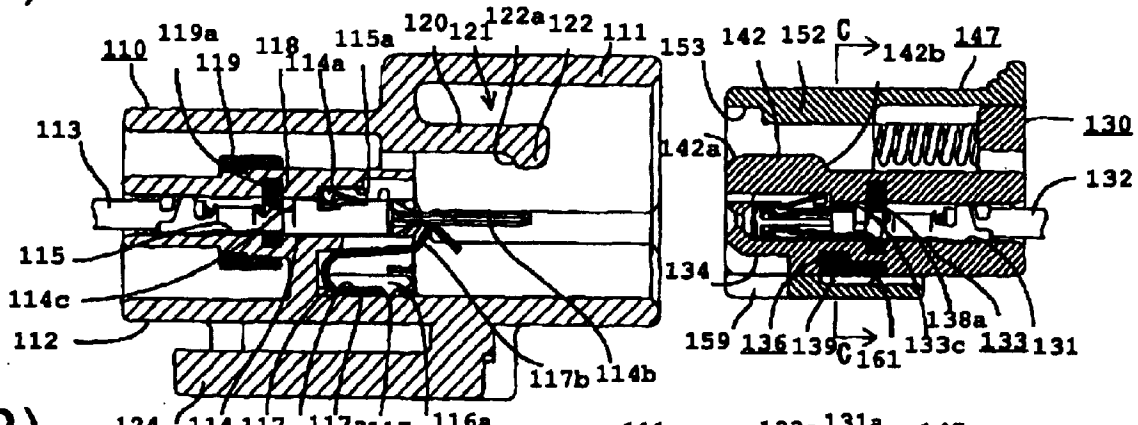
FIGS. 18(A) and 18(B) along 15(A)—15(A), 15(B)—15(B) of FIG. 12 but showing a state before the two housings are connected and with the retainer held at a full locking position.
Figure 18B:
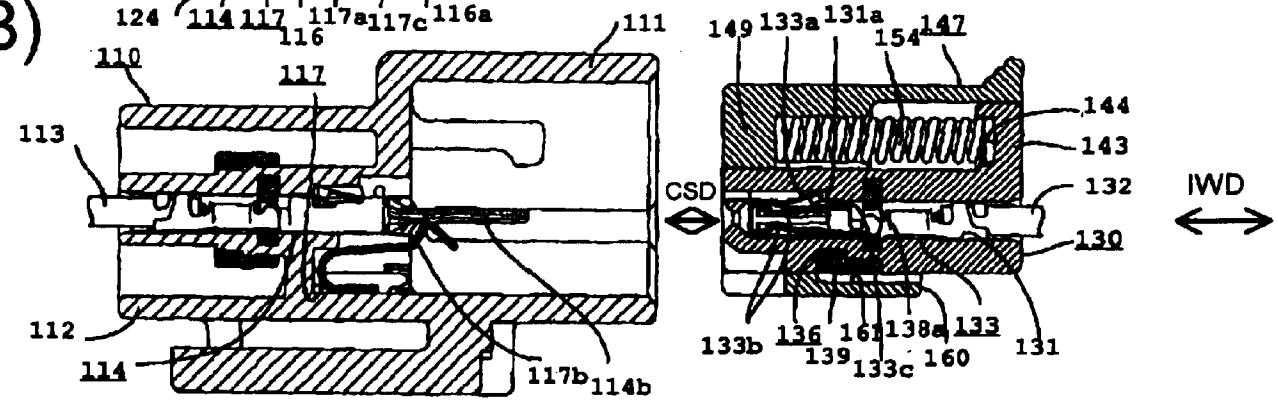

The male housing 110 is made e.g. of a synthetic resin and has a receptacle 111 in the form of a forwardly open rectangular tube. A terminal accommodating portion 112 is formed rearward of the receptacle 111 for accommodating male terminal fittings 114, as shown in FIGS. 11 and 18. The terminal accommodating portion 112 is formed with three cavities 115 that are arranged substantially side-by-side along a widthwise direction WD. The male terminal fittings 114 are crimped, bent or folded into connection with ends of wires 113 and are insertable into the cavities 115 from behind. A locking groove 115*a* is formed in the upper surface of each cavity 115 and has an open front end. The locking groove 115*a* receives a lock 114*a* that has been cut, bent, stamped and or embossed on the male terminal fitting 114.

A shorting-terminal accommodating chamber 116 is formed below the respective cavities 115 of the terminal accommodating portion 112 and has an open front end. A shorting terminal 117 is accommodated in the shorting-terminal accommodating chamber 116. The shorting terminal 117 includes a main portion 117*a* in the form of a substantially flat plate and two resilient contact pieces 117*b* projecting from the rear end of the main portion 117*a*. The leading ends of the respective resilient contact pieces 117*b* project into the receptacle 111 for resiliently contacting tabs 114*b* of the two male terminal fittings 114 accommodated in the middle and left cavities 115 of FIG. 11. Thus, the two male terminal fittings 114 can be shorted. Two holding pieces 116*a* are provided in the shorting-terminal accommodating chamber 116 and are engageable with locking holes 117*c* formed in the main portion 117*a*.

A retainer mount hole 118 is formed in one side surface of a rear part of the terminal accommodating portion 112 and intersects the respective cavities 115. A retainer 119 can be inserted into the retainer mount hole 118. The retainer 119 has locking sections 119*a* for locking the respective male terminal fittings 114 in the cavities 115 so as not to come out. Additionally, the retainer can be held in the male housing 110 by an unillustrated holding means as described with reference to the previous embodiment at a partial locking position or a full locking position. The locking sections 119*a* are retracted from the cavities 115 when the retainer is at the partial locking position to permit the insertion and withdrawal of the male terminal fittings 114 into and from the cavities 115. The locking sections 119*a* enter the cavities 115 to engage jaws 114*c* of the male terminal fittings 114 when the retainer 119 is at the full locking position. The retainer 119 is movable between the partial and full locking positions substantially along widthwise direction WD.

The receptacle 111 has an opening for receiving the female housing 130 and the slider 147. A lock arm 120 is cantilevered forward from a substantially widthwise middle of the back surface of the receptacle 111 above and near the respective cavities 115. The lock arm 120 is resiliently deformable up and down toward and away from the female housing 130 about a base end thereof at the back surface and can be retracted into a displacement permitting space 121 between the lock arm 120 and the ceiling surface of the receptacle 111. A hook 122 projects down from the leading end of the lock arm 120 and is engageable with a lock 142 on the female housing 130. A rear surface 122*a* of the hook 122 is a locking surface for the lock 142 and has a substantially arcuate shape sloped up and to the back. Two guiding recesses 123 are formed in opposed inner side surfaces of the receptacle 111 and substantially face each other. The guiding recesses 123 receive guiding ribs 158 of the slider 147. A mounting portion 124 used to mount the male housing 110 on an unillustrated bracket projects from the bottom surface of the male housing 110.

Figure 12:
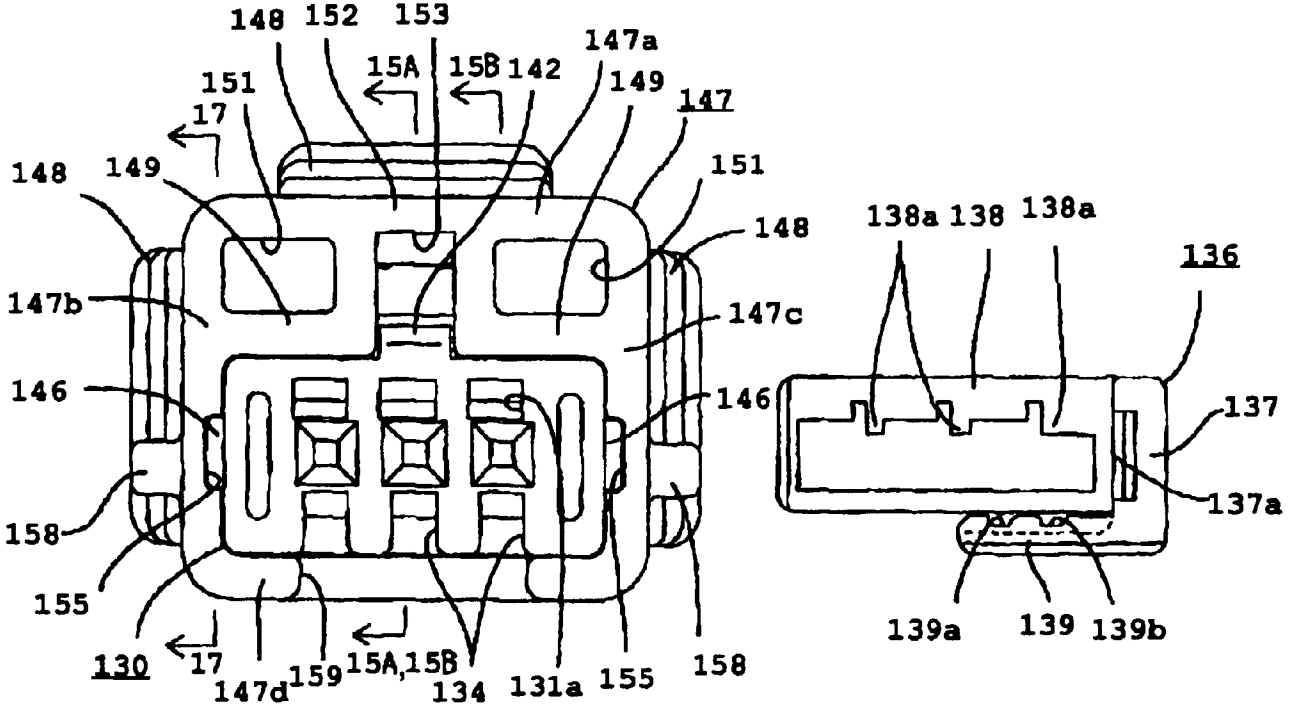
FIG. 12 is a front view showing a female housing having a slider mounted thereon and a retainer.
Figure 13:
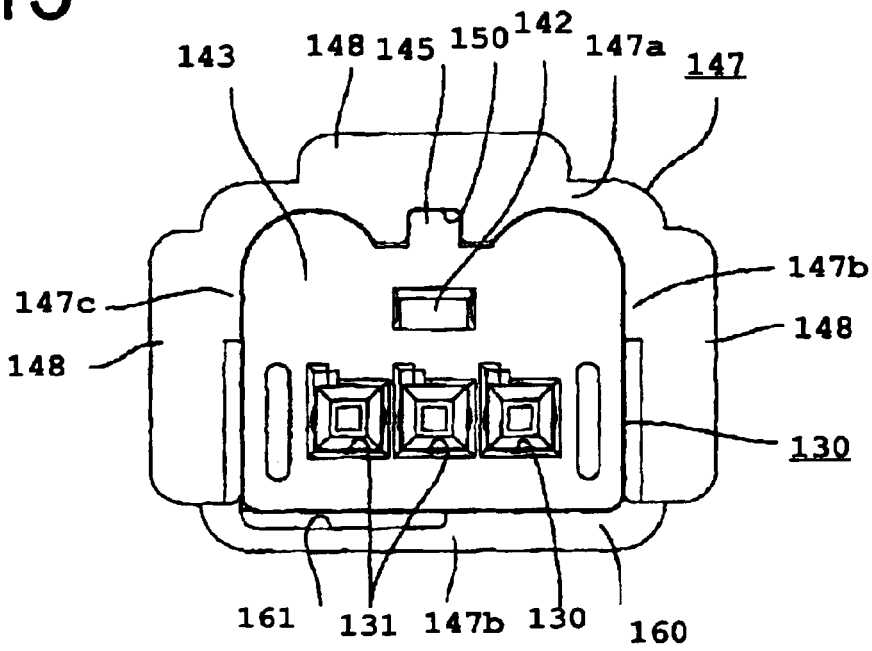
FIG. 13 is a rear view of the female housing having the slider mounted thereon.
Figure 14:
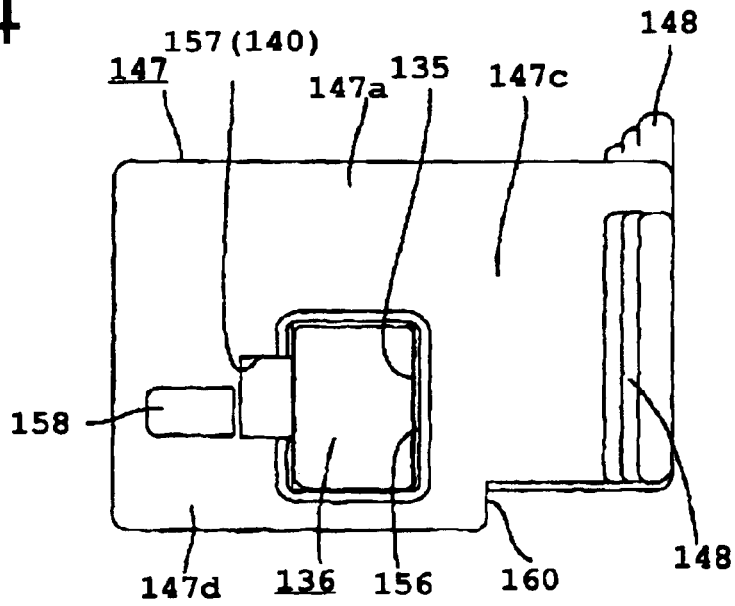
FIG. 14 is a side view of the female housing having the slider mounted thereon.
Figures 15A, 15B:
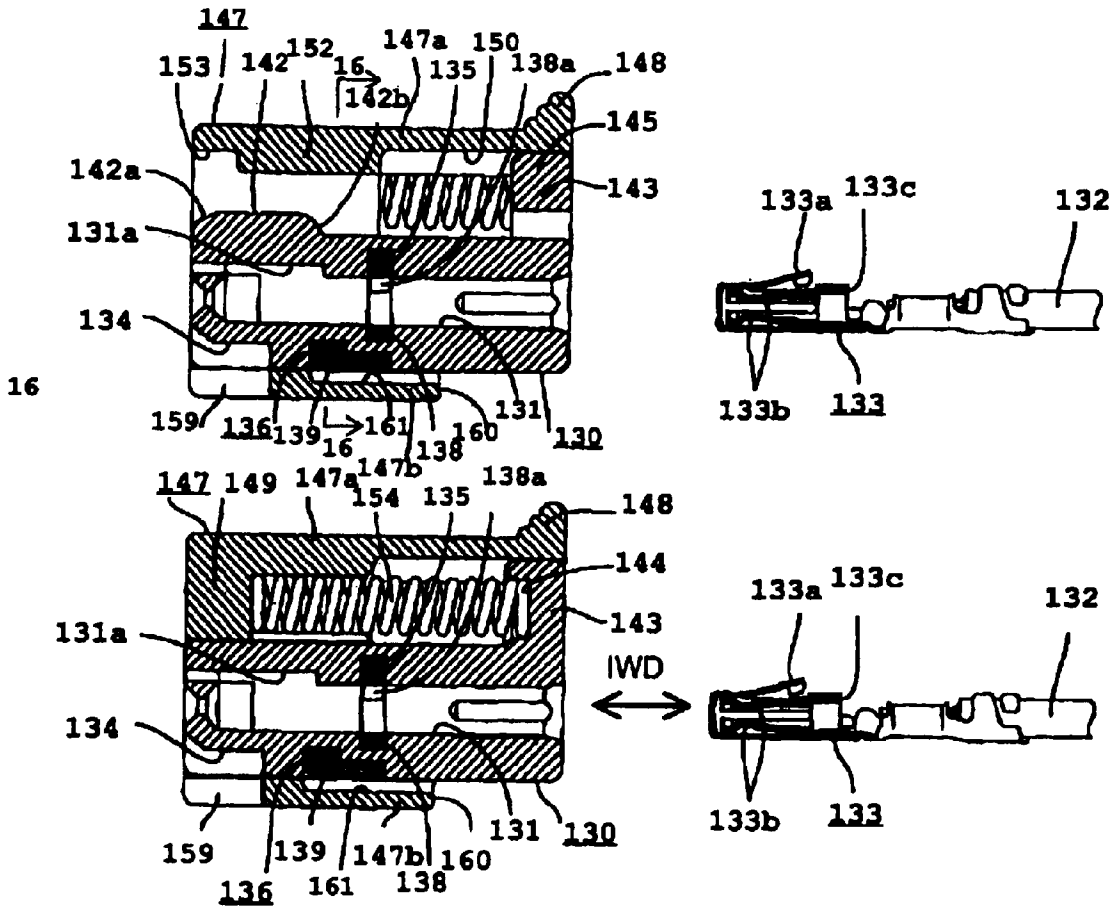
FIGS. 15(A) and 15(B) are sections along 15(A)—15(A), 15(B)—15(B) of FIG. 12 showing a state before a female terminal fitting is inserted with the retainer held at a partial locking position.

The female housing 130 is made e.g. of a synthetic resin and is substantially in the form of a wide block. Three cavities 131 are formed substantially side by side along widthwise direction WD in the female housing 130 as shown in FIGS. 12 and 15. Female terminal fittings 133 that have been crimped into connection with ends of wires 132 are insertable into the cavities 131 from behind. A locking groove 131*a* is formed in the upper surface of each cavity 131. The locking groove 131 has an open front end and a closed rear end. A locking portion 133*a* is formed in each female terminal fitting 133 by cutting and bending or embossing and is resiliently engageable with the closed rear end of the locking groove 131. Each female terminal fitting 133 is provided internally with a resilient contact piece 133*b* that can contact the tab 114*b* of the corresponding male terminal fitting 114. Three engaging recesses 134 are formed in the bottom surface of a front part of the female housing 130 immediately below and near the cavities 131. The engaging recesses 134 are engageable with the respective resilient contact pieces 117*b* of the shorting terminal 117. An engaging surface of each engaging recess 134 with the resilient contact piece 117*b* is sloped down and to right in FIG. 15 to deform the resilient contact piece 117*b* down and away from the male terminal fitting 114.

A retainer mount hole 135 is formed in one side surface of the female housing 130 and intersects the cavities 131. A retainer 136 is mountable in the retainer mount hole 135. The retainer 136 has a tall base 137. A locking plate 138 projects left from the left surface of the base 137 in FIG. 12, and a holding arm 139 projects left from the bottom end of the base 137 substantially parallel with the locking plate 138. An operable recess 137*a* is formed in the left inner edge of the base 137 and has an open front end into which a jig is insertable. A jig insertion recess 140 is formed at the front edge of the retainer mount hole 135 of the female housing 130 (see FIG. 14) and the jig used to operate the operable recess 137*a* can be inserted sideways into the jig insertion recess 140 from outside The locking plate 138 is a wide frame, and three locking sections 138*a* are formed substantially side-by-side at substantially even intervals in the upper inner surface of the locking plate 138 in FIG. 12 for engaging jaws 133*c* of the respective female terminal fittings 133. The holding arm 139 is a cantilever with forward and backward dimensions equal to forward and backward dimensions of the base 137. The holding arm 139 also has dimensions along a widthwise direction WD that are less than, and preferably slightly less than half, the corresponding dimension of the base 137. The holding arm 139 is resiliently displaceable up and down with respect to the female housing 130. A partial locking recess 139*a* and a full locking recess 139*b* are provided side by side along the transverse direction in the upper surface of the holding arm 139 and are engageable with a holding portion 141 that projects from the bottom surface of the retainer mount hole 135.

Figure 16:
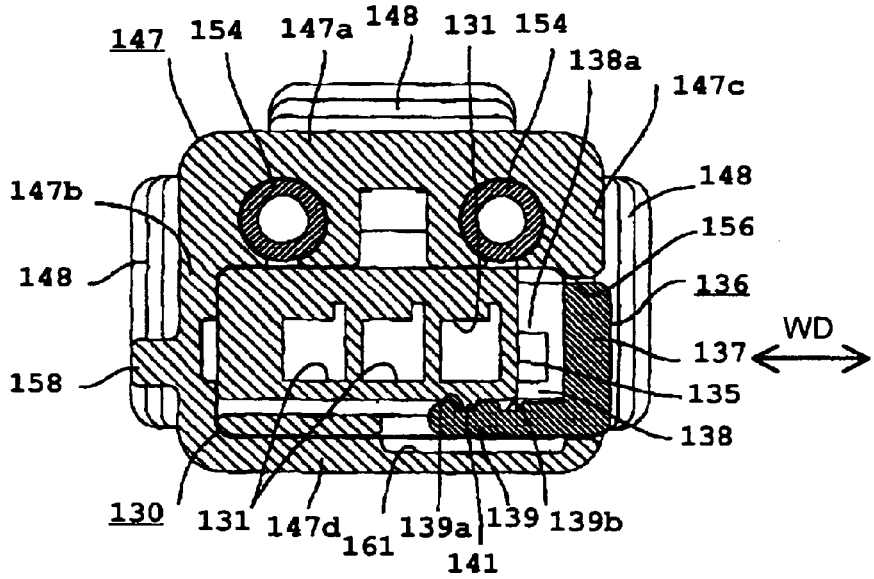
FIG. 16 is a section along 16—16 of FIG. 15 showing a state where the retainer is held at the partial locking position.
Figure 17:
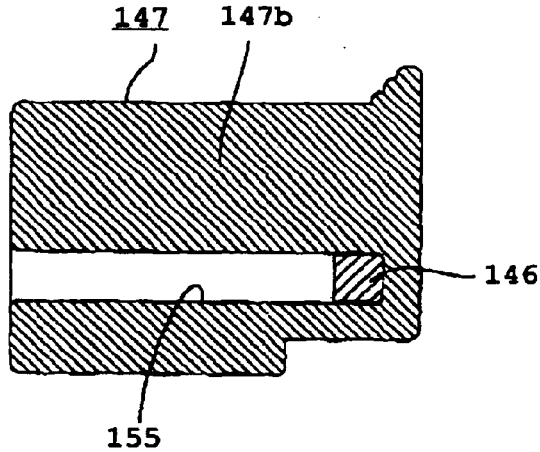
FIG. 17 is a section along 17—17 of FIG. 12.

The retainer 136 is movable along the widthwise direction WD substantially normal to the inserting and withdrawing directions IWD of the female terminal fittings 133 into and from the cavities 131. More particularly, the retainer 136 can be held selectively at a partial locking position (FIGS. 15 and 16) or a full locking position (FIGS. 18 and 19) by engaging the holding portion 141 with one of the partial locking recess 139*a* or the full locking recess 139*b* of the holding arm 139. The female terminal fittings 133 can be inserted into and withdrawn from the cavities 131 when the retainer 136 is at the partial locking position of FIGS. 15 and 16 because the locking sections 138*a* are retracted to right of the cavities 131, as shown in FIG. 16. At this position, the base 137 of the retainer 136 projects out sideways from the outer right surface of the female housing 130 over substantially the entire area. Additionally, the holding arm 139 is held substantially in its natural state by the engagement of the partial locking recess 139*a* with the holding portion 141 and does not project down from the bottom of the female housing 130.

Figure 19:
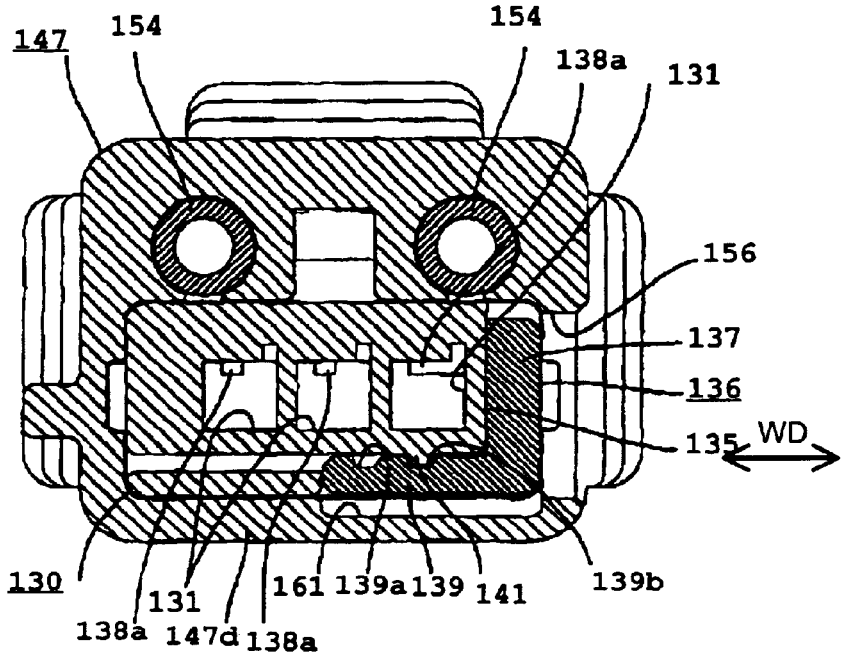
FIG. 19 is a section along 19—19 of FIG. 18 showing a state where the retainer is held at the full locking position.

On the other hand, the locking sections 138*a* are in the corresponding cavities 131 and engage the jaws 133*c* of the female terminal fittings 133 when the retainer 136 is at the full locking position (FIGS. 18 and 19). At this position, the retainer 136 is substantially completely in the retainer mount hole 135 so that the right surface of the retainer 136 and the right surface of the female housing 130 in FIG. 19 are substantially flush. Additionally, the holding arm 139 is held substantially in its natural state by the engagement of the full locking recess 139*b* with the holding portion 141 and does not project down from the bottom surface of the female housing 130. The holding arm 139 moves onto the holding portion 141 and is displaced below the bottom surface of the female housing 130 (see FIG. 26) during movement of the retainer 136 between the partial and full locking positions.

The lock 142 engageable with the lock arm 120 projects at a substantially widthwise middle position at the front end of the upper surface of the female housing 130. The height of the lock 142 is substantially equal to the height of the hook 122, and a front surface 142*a* of the lock 142 slopes up and back to guide a movement of the lock arm 120 onto the lock 142. On the other hand, a rear surface 142*b* of the lock 142 has a substantially arcuate shape sloped down and back for engaging the rear surface 122*a* of the hook 122. Thus, when a force of a specified intensity or higher acts to separate the two housings 110, 130 while the hook 122 is engaged with the lock 142, the lock arm 120 is displaced automatically to cancel the locked state. Accordingly, locking means of the two housings take a semi-locking construction.

A rear wall 143 projects up from the rear end of the upper surface of the female housing 130 and has substantially the same width as the female housing 130. Opposite widthwise sides of the rear wall 143 have two recessed spring receiving portions 144 for supporting the rear ends of the compression coil springs 154. A catch 145 projects up and out from a substantially widthwise middle of the rear wall 143 and is engageable with the slider 147. Further two front-stops 146 project from the opposite outer side surfaces of the rear end of the female housing 130 for stopping the slider 147 at its front-limit position.

The slider 147 is made e.g. of a synthetic resin, and defines a substantially rectangular tube with upper, lower, left and right walls 147*a* to 147*d* shown in FIG. 12. The slider 147 has a length substantially equal to the length of the female housing 130 and surrounds the female housing 130 over the substantially entire circumference. The lengths of the slider 147 and the female housing 130 exceed the length of the receptacle 111. Thus, the rear ends of the female housing 130 and the slider 147 project back from the receptacle 111 when the two housings 110, 130 are connected properly (see FIG. 22). The slider 147 is movable forward and back substantially along the connecting and separating directions CSD of the two housings 110, 130, and the inner surface of the slider 147 is substantially in sliding contact with the outer surface of the female housing 130 over substantially its entire area during the movement of the slider 147. A tiny clearance between the female housing 130 and the slider 147 smoothes the relative movement of the slider 147. Further, three pullable portions 148 project out from or at the rear ends of the upper, left and right walls 147*a*, 147*b*, 147*c* of the slider 147 and can be used to pull the slider 147.

Two spring pressing portions 149 project from substantially opposite widthwise sides of the upper wall 147*a* of the slider 147 for tightly holding the compression coil springs 154 in cooperation with the spring receiving portions 144 and for supporting the front ends of the compression coil springs 154. The spring pressing portions 149 are at the opposite sides of the lock 142 in the mounted state of the slider 147, and have a width and height so that the lower surfaces are held substantially in sliding contact with the upper surface of the female housing 130. A catching groove 150 is formed in the inner surface of a rear part of the upper wall 147*a* and has an open rear end and a closed front end. The catch 145 can slide in the catching groove 150, and the front surface of the catch 145 engages the closed front end of the catching groove 150 when the slider 147 is moved maximally back (see FIG. 23). Two bores 151 are formed in the front surfaces of the upper side portion 147*a* and both spring pressing portions 149 for preventing sink marks during molding.

A space is defined between the lock 142 and a lower surface of the upper wall 147*a* of the slider 147. The space has a height substantially corresponding to the height of the lock arm 120 excluding the hook 122. Thus, the lock arm 120 can enter this space when the lock arm 120 is in its natural state. The widthwise middle of the upper wall 147*a* defines a displacement-preventing portion 152 for entering the displacement permitting space 121 for the lock arm 120 to prevent a displacement of the lock arm 120 when the two housings 110, 130 are connected (see FIG. 22(A)). A displacement permitting recess 153 is formed in the inner surface of the front end of the displacement-preventing portion 152 and has an open front end (see FIG. 20(A)). The displacement-permitting recess 153 permits the lock arm 120 to be displaced when the lock arm 120 moves onto the lock 142. However, the front-end surface of the resiliently displaced lock arm 120 abuts against the back end surface of the displacement permitting recess 153. Accordingly, the lock arm 120 that has been displaced resiliently into the displacement permitting recess 153 can interfere with the slider 147. However, the lock arm 120 does not interfere with the slider 147 in the natural state of the lock arm 120.

Two front-stop grooves 155 are formed in the left and right walls 147*b*, 147*c* of the slider 147 and are engageable with the front-stop projections 146 of the female housing 130. The slider 147 can be held at its front-limit position so as not to move any further forward by the engagement of the front-stop projections 146 and the front-stop grooves 155 (see FIG. 17). The front and rear end surfaces of the female housing 130 and the slider 147 are substantially flush with each other when the slider 147 is at the front limit position shown in FIGS. 14 and 15. Additionally, the compression coil springs 154 are compressed slightly to prevent the slider 147 from shaking along forward and backward directions when the slider 147 is at the front limit position. The right wall 147*c* of FIG. 12 has a retainer insertion hole 156 through which the retainer 136 is insertable and which can be aligned with the retainer mount hole 135 of the female housing 130 when the slider 147 is at the front-limit position. A jig insertion hole 157 is formed at the front edge of the retainer insertion hole 156 for receiving the jig used to operate the operable recess 137*a* of the retainer 136. The jig insertion hole can be aligned with the jig insertion recess 140 when the slider 147 is at the front-limit position (see FIG. 14). Two guiding ribs 158 are formed on the outer surfaces of the left and right walls 147*b*, 147*c* for being engaged with the guiding recesses 123 of the male housing 110 and guiding the movement of the slider 147.

A cut-away portion 159 is formed at the front end of the lower wall 147*b* of the slider 147 for receiving the resilient contact pieces 117*b* of the shorting terminal 117. The cut-away portion 159 is formed in a width range to span all the engaging recesses 134 and the rear end of the cut-away portion 159 substantially aligns with the rear ends of the engaging recesses 134 when the slider 147 is at the front-limit position on the female housing 130. An escaping portion 160 is made at the rear part of the lower wall 147*d* over a specified length, so that the lower wall 147*d* does not project back from the female housing 130 even if the slider 147 is moved backward in the connecting process and a part of the rear end surface of the female housing 130 below the respective cavities 131 can be pushed easily to connect the two housings 110, 130 (see FIG. 21).

The lower wall 147*d* of the slider 147 faces the holding arm 139 of the retainer 136 from below, and a rearwardly open recess 161 is formed in the inner surface of the lower wall 147*d* facing the holding arm 139. The recess 161 is in a width range substantially equaling a sum of the dimensions of the base 137 and the holding arm 139 along a widthwise direction WD at a side of the lower wall 147*d* toward the side wall 147*c*, and the depth of the recess 161 is slightly smaller than half the thickness of the lower wall 147*d* (see FIG. 13). The front end of the recess 161 substantially aligns with the front end of the holding arm 139 when the slider 147 is at the front-limit position, thereby permitting the holding arm 139 to be displaced resiliently down. Accordingly, the resiliently displaced holding arm 139 can enter the recess 161 and interfere with the front-end surface of the recess 161 in the slider 147 when the retainer 136 is between the partial locking position and the full locking position. However, the holding arm 139 in its natural state is retracted from the recess 161 and does not interfere with the slider 147 when the retainer 136 is at the partial locking position or at the full locking position. A projecting distance of the resiliently displaced holding arm 139 into the recess 161 is significantly larger than the clearance between the female housing 130 and the slider 147. In this way, the recess 161 forms an interference space. The holding arm 139 is covered by the part of the lower wall 147*b* of the slider 147 where the recess 161 is formed without being exposed to the outside.

The compression coil springs 154 and the slider 147 are assembled successively with the female housing 130 from front and the slider 147 is held at its front-limit position. Additionally, the retainer 136 is mounted sideways into the retainer mount hole 135 through the retainer insertion hole 156 and is held at the partial locking position. The locking sections 138*a* are retracted sideways from the corresponding cavities 131 when the retainer 136 is at the partial locking position. Furthermore, the base 137 is in the retainer insertion hole 156, but projects out sideways from the slider 147, as shown in FIGS. 15 and 16. Thereafter, the respective female terminal fittings 133 connected with the wires 132 are inserted into the cavities 131 from behind and partly locked by the locks 133*a*. After all the female terminal fittings 133 are inserted, the retainer 136 is pushed sideways to the full locking position through the retainer insertion hole 156.

Figure 26:
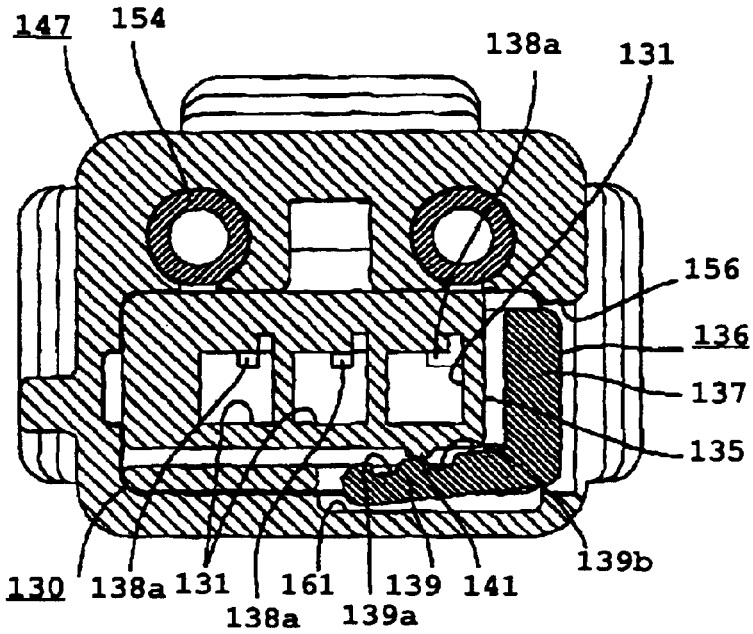
FIG. 26 is a section along 26—26 of FIG. 25 showing a partly inserted state of the retainer.

A projecting distance of the base 137 into the retainer insertion hole 156 gradually decreases while the retainer 136 is being moved from the partial locking position to the full locking position, as shown in FIG. 26. Additionally, the holding arm 139 moves onto the holding portion 141 and is displaced resiliently down into the recess 161. The projecting distance of the holding arm 139 into the recess 161 gradually increases. The locking sections 138*a* enter the cavities 131 to engage the jaws 133*c* of the female terminal fittings 133 when the retainer 136 reaches the full locking position shown in FIGS. 18 and 19. As a result, the female terminal fittings 133 are locked doubly. At this time, the base 137 is retracted completely from the retainer insertion hole 156. Additionally, the holding arm 139 moves over the holding projection 141 and is restored so that the holding portion 141 engages the full locking recess 139*b*. As a result, the holding arm 139 is brought back towards its natural state and is retracted completely from the recess 161. Accordingly, the slider 147 does not interfere with the retainer 136 and can move relative to the female housing 130.

Figure 20A:
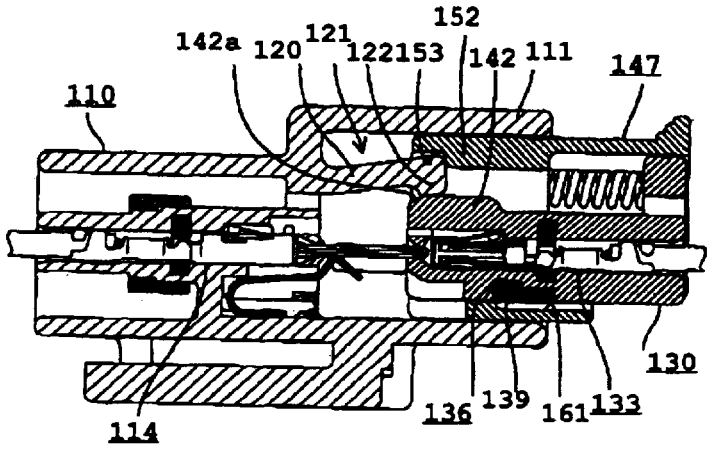
FIGS. 20(A) and 20(B) are sections are sections along lines 20A—20A and 20B—20B of FIG. 11 and along line 15A—15A and 15B—15B of FIG. 12 and showing an initial stage of the connection of the two housings.
Figure 20B:
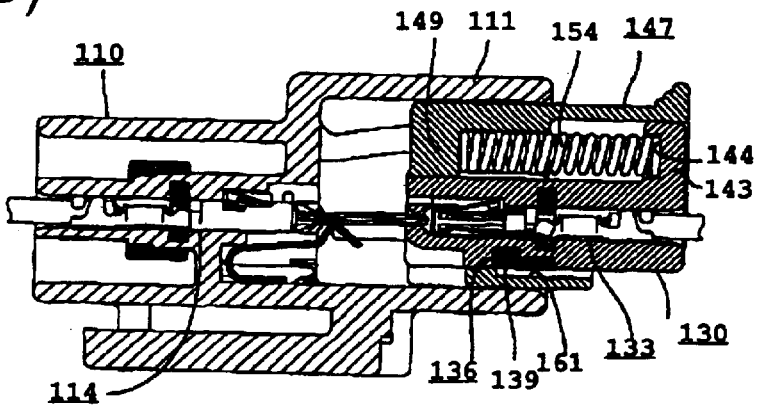

Connection is achieved by aligning the female housing 130 and the slider 147 opposite the receptacle 111 from the front, as shown in FIG. 18. The female housing 130 and the slider 147 then are inserted into the receptacle 111 of the male housing 110. The hook 122 is guided onto the front surface 142*a* of the lock 142, as shown in FIG. 20, and moves over the lock 142 when the housings 110, 130 are connected to a specified depth. Thus, the lock arm 120 is displaced away from the female housing 130 and into the displacement permitting space 121 and the displacement permitting recess 153.

Figure 21A:
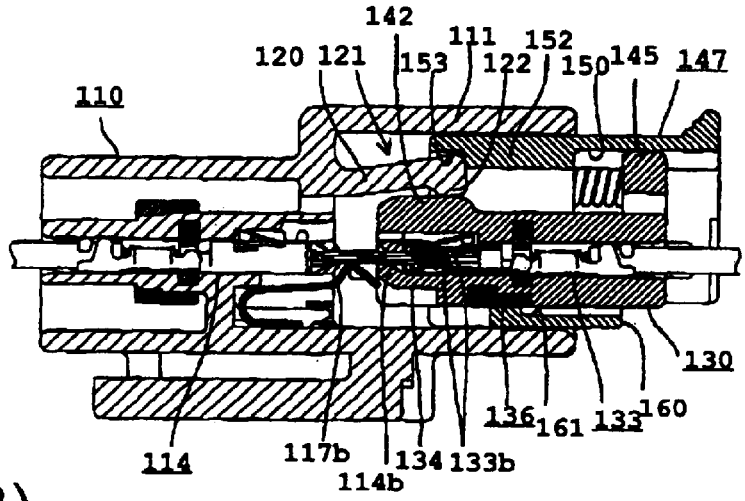
FIGS. 21(A) and 21(B) are sections similar to FIGS. 20(A) and 20(B), but showing an intermediate stage of the connection of the two housings.
Figure 21B:
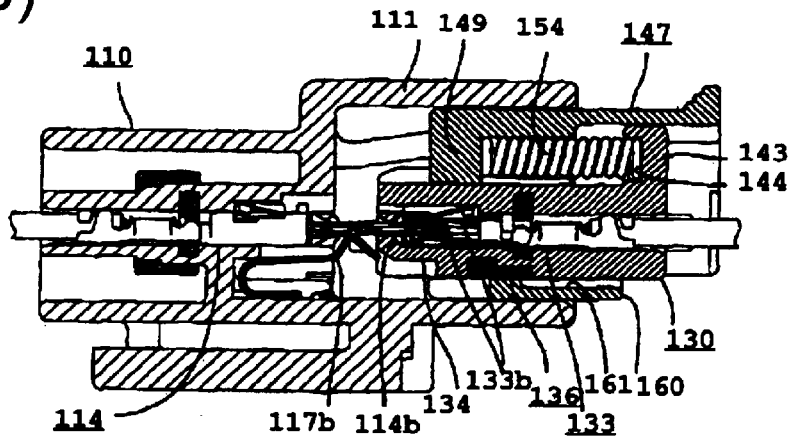

As the connection progresses, the back end surface of the displacement permitting recess 153 is pushed by the front end surface of the resiliently displaced lock arm 120, as shown in FIG. 21. As a result, the slider 147 is moved back relative to the female housing 130 and the compression coil springs 154 are compressed. In this process, the tabs 114*b* of the male terminal fittings 114 start being brought resiliently into contact with the resilient contact pieces 133*b* of the female terminal fittings 133.

An operator could interrupt the connecting operation at an intermediate stage. However, biasing forces accumulated in the compressed coil springs 0.154 are released. Thus, the slider 147 is biased forward and pushes the lock arm 120 in a disengaging direction from the lock 142, and the two housings 110, 130 are separated. Accordingly, the two housings 110, 130 cannot be left partly connected.

Figure 22A:
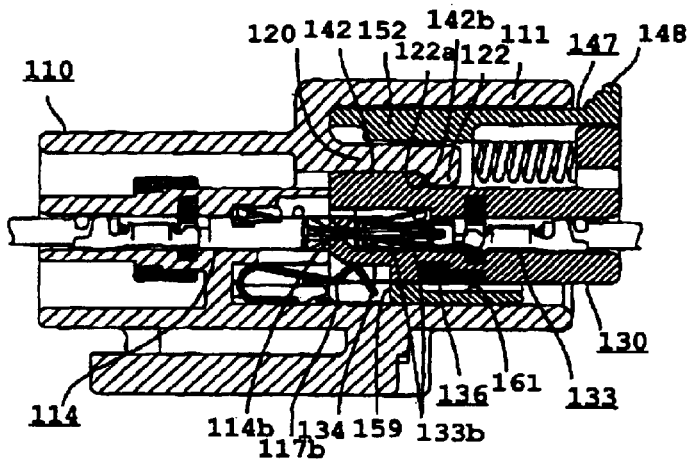
FIGS. 22(A) and 22(B) are sections similar to FIGS. 20(A) and 20(B), but showing a properly connected state of the two housings.
Figure 22B:
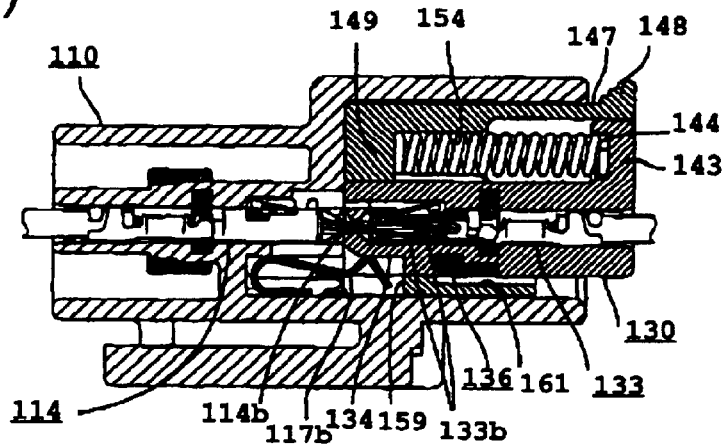

The hook 122 moves over the lock 142 to restore the lock arm 120, as shown in FIG. 22, when the housings 110, 130 are connected to a proper depth. Thus, the rear surface 122*a* of the hook 122 engages the rear surface 142*b* of the lock 142. Simultaneously or subsequently, the front end of the lock arm 120 is disengaged from the back end surface of the displacement permitting recess 153 to cancel the pushed state. Thus, the biasing forces accumulated in the compression coil springs 154 are released to move the slider 147 forward until the slider 147 reaches the front-limit position where the slider 147 was before the connecting operation. The displacement preventing portion 152 enters the displacement permitting space 121 for the lock arm 120 as the slider 147 is moved forward and prevents displacement of the lock arm 120. In this way, the housings 110, 130 are locked redundantly and are held firmly so as not to separate. The resilient contact pieces 117*b* of the shorting terminal 117 displace resiliently down away from the tabs 114*b* and into both the engaging recesses 134 and the cut-away portion 159 in the process of connecting the two housings 110, 130. Therefore, the shorted state of the two male terminal fittings 114 is canceled.

Figure 23A:
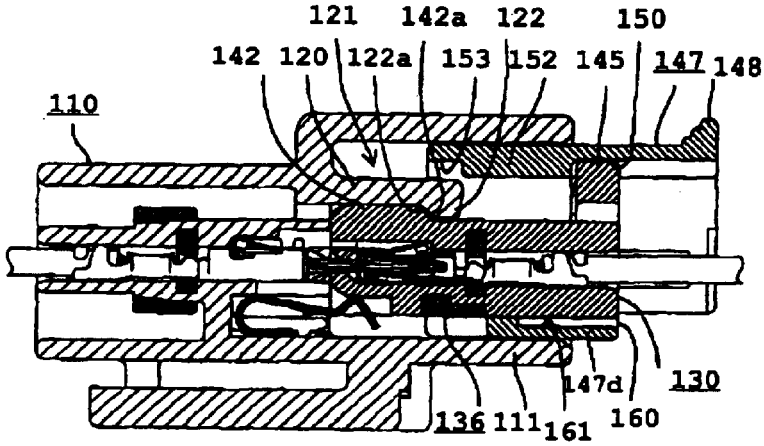
FIGS. 23(A) and 23(B) are sections similar to FIGS. 20(A) and 20(B), but showing a state where the slider is moved backward.
Figure 23B:
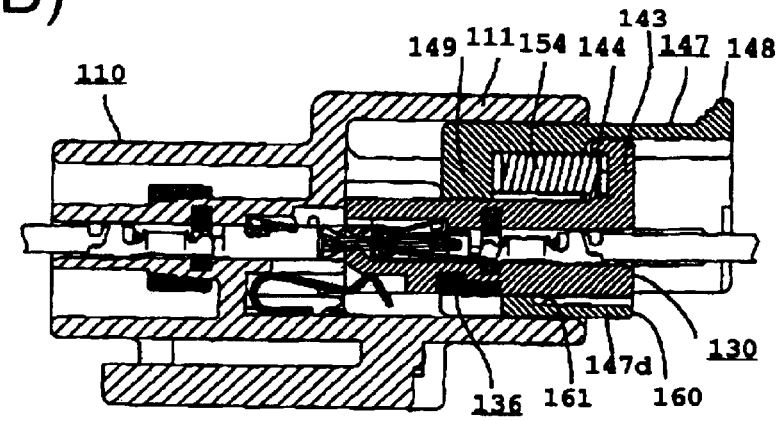
Figure 24A:
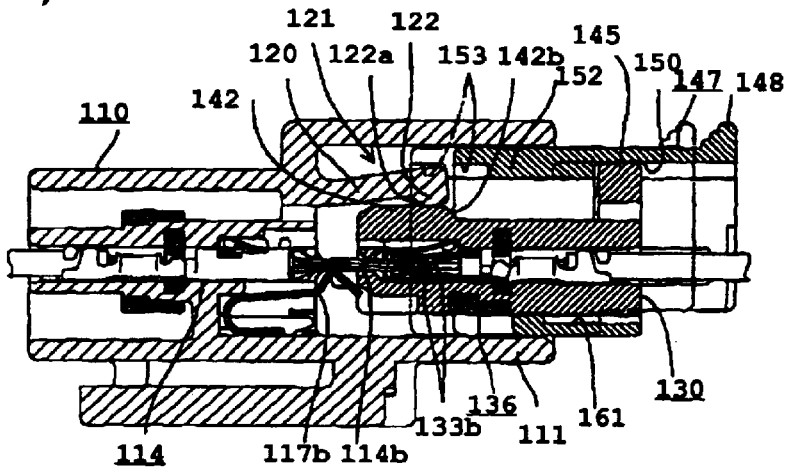
FIGS. 24(A) and 24(B) are sections similar to FIGS. 20(A) and 20(B), but showing an intermediate stage of the separation of the two housings.
Figure 24B:
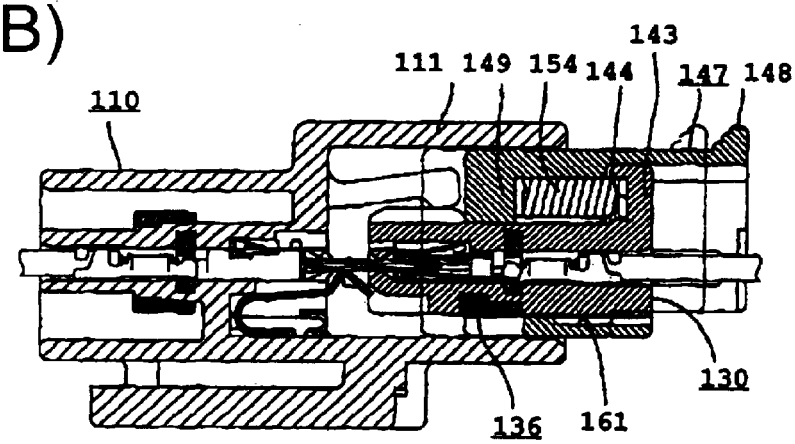

The two housings 110, 130 may be separated for maintenance or other reason. In such a case, the respective pullable portions 148 at the rear end of the slider 147 and projecting back from the receptacle 111 are pulled. The slider 147 is moved back against the biasing forces of the compression coil springs 154. The catch 145 escapes into the catching groove 150 and reaches a position where the front-end surface of the catch 145 engages the front end of the catching groove 150. The displacement-preventing portion 152 then is retracted completely from the displacement permitting space 121 for the lock arm 120 and the displacement permitting recess 153 is above the front end of the lock arm 120 as shown in FIG. 23. As a result, the lock arm 120 is permitted to displace. The slider 147 then is pulled further back from this state, and the lock arm 120 is guided automatically through a displacement by the rear surface 122*a* of the hook 122 and the rear surface 142*b* of the lock 142 as shown in FIG. 24, thereby being freed from the locking state. The female housing 130 and/or the slider 147 then can be pulled backward and out of the receptacle 111.

An operator could interrupt the separating operation at an intermediate stage. However, the biasing forces of the compression coil springs 154 are released. Thus, the slider 147 is moved forward as shown by phantom in FIG. 24 and the front end surface of the resiliently displaced lock arm 120 abuts the back end surface of the displacement permitting recess 153 to forcibly separate the two housings 110, 130. This prevents the two housings 110, 130 from being left partly connected during a separating operation.

Figure 25:
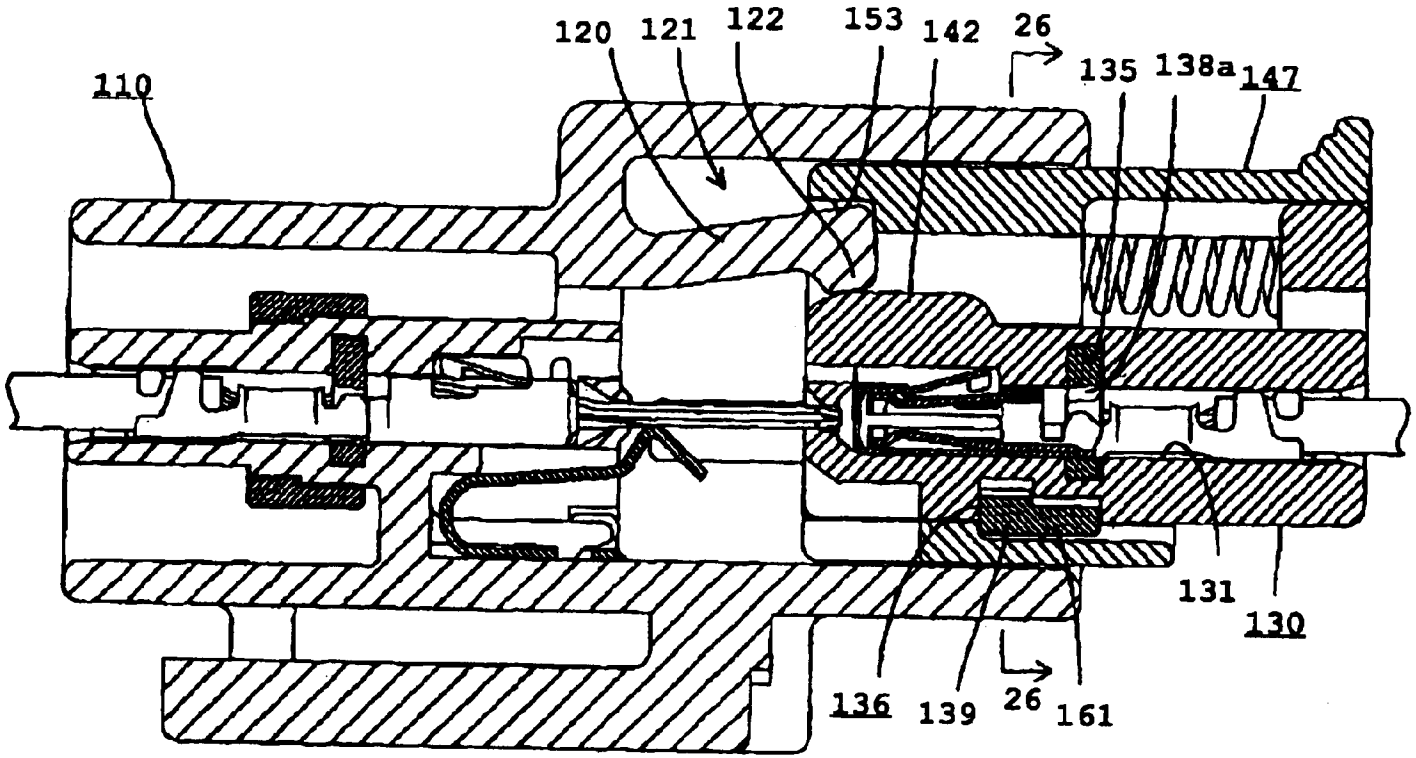
FIG. 25 is a section similar to FIG. 15(A), but showing a state where the two housings cannot be connected due to the partly inserted retainer.

The retainer 136 may be pushed insufficiently and may not reach the full locking position during assembly of the female housing 130. In such a case, the base 137 of the retainer 136 projects into the retainer insertion hole 156 and the holding arm 139 moves onto the holding portion 141 and is displaced into the recess 161, as shown in FIG. 26. An attempt could be made to connect the two housings 110, 130 in this state. However, the front end surface of the base 137 abuts the front end surface of the retainer insertion hole 156 and the front end surface of the holding arm 139 abuts the front end of the recess 161, as shown in FIG. 25, to restrict backward movement of the slider 147. Accordingly, the housings 110, 130 cannot be connected, and partial insertion of the retainer 136 is detected.

The retainer 136 may not be pushed at all towards the full locking position. In this situation, the holding arm 139 is its natural state and is retracted from the recess 161, as shown in FIG. 16. However, the base 137 projects in the retainer insertion hole 156 and contacts the front-end surface of the retainer insertion hole 156 to prevent backward movement of the slider 147. Thus, the two housings 110, 130 cannot be connected, and the failure to push the retainer 136 is detected.

The female terminal fitting 133 can be detached from the female housing 130 by inserting the jig sideways into the jig insertion recess 140 through the jig insertion hole 157 so that the jig catches the operable recess 137*a* facing the jig insertion recess 140. The jig then is pulled to move the retainer to the partial locking position. Thus, the locked state of the female terminal fitting 133 by the retainer 136 is canceled (see FIG. 14). Another jig then is inserted into the locking groove 131*a* from the front and resiliently deforms the lock 133*a* to cancel the locking state. The wire 132 then is pulled back to remove the female terminal fitting 133 from the cavity 131.

As described above, the holding arm 139 is displaced to increase the projecting distance into the recess 161 while the retainer 136 is moved towards the full locking position. Accordingly, a sufficient interference area of the retainer 136 with the slider 147 is ensured even immediately before the retainer 136 reaches the full locking position. Thus, the retainer 136 prevents movement of the slider 147, and hence prevents connection of the housings 110, 130. Accordingly, partial insertion of the retainer 136 is detected securely. A clearance is defined between the female housing 130 and the slider 147 to smooth the movement of the slider 147. However, the partial insertion of the retainer 136 is detected securely because a sufficient interference area between the retainer 136 and the slider 147 is ensured.

The holding arm 139 is covered by a part of the slider 147, and hence is prevented from damage by external matter. As a result, the female terminal fittings 133 are locked with improved reliability.

The invention is not limited to the above described embodiment. For example, the following embodiments also are embraced by the invention. Beside the following embodiments, various changes can be made without departing from the scope of the invention as defined by the claims.

The recess for receiving the holding arm is formed in the slider in the foregoing embodiment. However, the recess may be omitted and the lower wall of the slider may be shortened to extend only to a position immediately before the holding arm so that holding arm interferes with the rear end surface of the lower wall. In such a case, a space behind the lower wall of the slider is an interference space. Further, although the slider has a tubular shape in the foregoing embodiment, it may be flat or substantially L- or U-shape.

The retainer is movable between the partial locking position and the full locking position in the foregoing embodiment. However, the retainer may be moved directly to the full locking position to lock the female terminal fittings.

The resiliently displaced lock arm pushes the slider in the foregoing embodiment. However, the locking means may be an inertial locking mechanism and the lock arm in its natural state may push the slider.

The lock arm is the resilient displacing portion in the foregoing embodiment. However, the resilient displacing portion may be separate from the lock arm according to the present invention.

The locking means has a semi-locking construction in the foregoing embodiment and the displacement-preventing portion of the slider prevents the displacement of the lock arm. However, the displacement-preventing portion may be omitted and the lock may have an ordinary locking construction (e.g. formed by vertically straight rear surfaces of the hook and the lock).

Converse to the foregoing embodiment, the slider and the compression coil springs may be assembled with the male housing and the lock arm may be provided in the female housing according to the present invention.

A wire-to-wire connector is illustrated in the foregoing embodiment. However, the invention is also applicable, for example, to connectors directly connected with equipment, printed circuit boards, junction boxes, etc.

What is claimed is:

1. A connector comprising: a housing having an end and a chamber open in the end, at least one receiving groove adjacent the chamber, the receiving groove being open towards the end of the housing and having a closed stop surface facing the end of the housing, a plurality of terminal fittings and at least one shorting terminal accommodated in the housing, the shorting terminal having a main portion in the chamber, at least one contact piece extending from the main portion for contacting the terminal fittings, and at least one pushable piece bent from the main portion and disposed in the receiving groove, the pushable piece having a positioning edge abutting against the closed stop surface of the receiving groove and a pushing edge facing oppositely from the positioning edge and towards the end of the housing to be pushed for urging the shorting terminal into the housing, the pushable piece being bent at the main portion so that having a plate surface that extends between the positioning and pushing edges substantially along a pushing direction of the shorting terminal into the housing, whereby engagement between the positioning edge of the pushable piece and the closed stop surface of the receiving groove restricts a depth to which the shorting terminal is pushed.

2. The connector of claim 1, wherein two pushable pieces are formed at opposite lateral ends of the main portion.

3. The connector of claim 2, wherein the plate surface of the pushable pieces are configured for sliding contact with corresponding surfaces of the receiving grooves in the process of pushing the shorting terminal.

4. The connector of claim 3, wherein the receiving grooves have a length and a height at least equal to a length and height of the pushable pieces.

5. The connector of claim 1, further comprising locking means on at least one of the shorting terminal and the housing for locking the shorting terminal at a proper depth in the housing.

6. The connector of claim 1, wherein a dimension of the pushable pieces along the pushing direction is longer than ⅓ of the corresponding dimension of the main portion.

7. The connector of claim 1, wherein the pushing edges of the pushable pieces are substantially aligned with a front end of the main portion.

8. A shorting terminal to be accommodated in a housing, comprising:

a main portion having opposite front and rear edges and first and second opposite lateral ends;

at least one contact piece extending from the rear edge of the main portion for contacting terminal fittings in at least one of the housing and a mating housing; and first and second pushable pieces to be pushed for urging upon the shorting terminal into the housing, the first and second pushable pieces being bent from the first and second opposite lateral ends of the main portion so that plate surfaces of the pushable pieces extend substantially along a pushing direction of the shorting terminal, each of said pushable pieces having a pushing edge substantially aligned with the front edge of the main portion and a positioning edge opposite the pushing edge, whereby the positioning edge of the pushable piece can be received against a closed end of a corresponding receiving portion of the housing to restrict a depth to which the shorting terminal is to be pushed.

* * * * *